US006523451B1

(12) United States Patent
Liao et al.

(10) Patent No.: US 6,523,451 B1
(45) Date of Patent: Feb. 25, 2003

(54) PRECISION SERVO CONTROL SYSTEM FOR A PNEUMATIC ACTUATOR

(75) Inventors: Chen-Fu Liao, Maple Grove, MN (US); Paul B. Gladen, Golden Valley, MN (US); Keith Hochhalter, Minnetrista, MN (US)

(73) Assignee: Tol-O-Matic, Inc., Hamel, MN (US)

( * ) Notice: Subject to any disclaimer, the term of this patent is extended or adjusted under 35 U.S.C. 154(b) by 0 days.

(21) Appl. No.: 09/699,039

(22) Filed: Oct. 27, 2000

Related U.S. Application Data

(60) Provisional application No. 60/161,875, filed on Oct. 27, 1999, and provisional application No. 60/240,765, filed on Oct. 17, 2000.

(51) Int. Cl.[7] ..... F15B 9/09

(52) U.S. Cl. ..... 91/363 R; 91/397; 91/417 R

(58) Field of Search ..... 91/397, 398, 361, 91/363 R, 417

(56) References Cited

U.S. PATENT DOCUMENTS

| | | | |
|---|---|---|---|
| 4,106,390 A | 8/1978 | Kodaira et al. | |
| 4,481,451 A | 11/1984 | Kautz et al. | |
| 4,628,499 A | 12/1986 | Hammett | |
| 4,666,374 A | 5/1987 | Nelson | |
| 4,741,247 A | 5/1988 | Glomeau et al. | |
| 4,763,560 A | 8/1988 | Sasaki | |
| 4,790,233 A | 12/1988 | Backe et al. | |
| 4,819,543 A | 4/1989 | Leinen | |
| 4,878,417 A | 11/1989 | Facon | |
| 4,901,625 A | 2/1990 | Bussan et al. | |
| 4,907,493 A | 3/1990 | Bellanger et al. | |
| 4,932,311 A | 6/1990 | Mibu et al. | |
| 5,154,207 A | 10/1992 | Bolt | |
| 5,424,941 A | 6/1995 | Bolt et al. | |
| 6,003,428 A | 12/1999 | Mundie et al. | |
| 6,085,632 A | 7/2000 | Stoll et al. | |
| 6,234,060 B1 * | 5/2001 | Jolly | 91/361 |

FOREIGN PATENT DOCUMENTS

| | | |
|---|---|---|
| DE | 2327387 | 12/1974 |
| DE | 3313 623 | 10/1984 |
| WO | WO 00/53936 | 9/2000 |

* cited by examiner

*Primary Examiner*—Edward K. Look
*Assistant Examiner*—Michael Leslie
(74) *Attorney, Agent, or Firm*—Patterson, Thuente, Skaar & Christensen, P.A.

(57) ABSTRACT

A precision servo control system for a pneumatic actuator has a piston positionable over a stroke of the pneumatic actuator using a supply of pressurized gas. A brake and a sensor system are connected to the actuator and to the servo control system. The servo control system operates to initiate the forward thrust from the pressurized gas to move the piston along the stroke. When a braking point along the stroke is determined, the servo control system initiates a reverse thrust from the pressurized gas while maintaining the forward thrust and simultaneously begins to selectively apply the brake to stop the piston within a predetermined tolerance of a desired stopping position. The precision servo control system is easily programmable in a manner similar to that of a control system for electrical actuators. The precision servo control system can maintain the predetermined tolerance even under changing loads, long stroke lengths or vertically oriented stroke directions. The precision control servo system preferably utilizes simple directional valves, instead of complex and expensive servo valves, to regulate the pressurized gas. The precision servo control system achieves positional accuracy to a predetermined tolerance that is a fixed value, regardless of the stroke length.

22 Claims, 22 Drawing Sheets

FILE TSPF14,LOAD 35#, X=I-E,
T=IF0,2B4, I20, SP=C

DISPLACEMENT = 76.778 IN
MAX. COMMANDED
SPEED = 71 IN/SEC

FILE TSPF15,LOAD 35#, X=I-A,
T=IF0,IFC, I20, SP=A

DISPLACEMENT = 53.154 IN
MAX. COMMANDED
SPEED = 59 IN/SEC

FILE TSPF16,LOAD 35#, X=I-8,
T=IF0,IE4, I20, SP=8

DISPLACEMENT = 41.342 IN
MAX. COMMANDED
SPEED = 47 IN/SEC

FILE TSPF17,LOAD 35#, X=I-6,
T=I80,35a, I20, SP=6

DISPLACEMENT = 29.53 IN
MAX. COMMANDED
SPEED = 35 IN/SEC

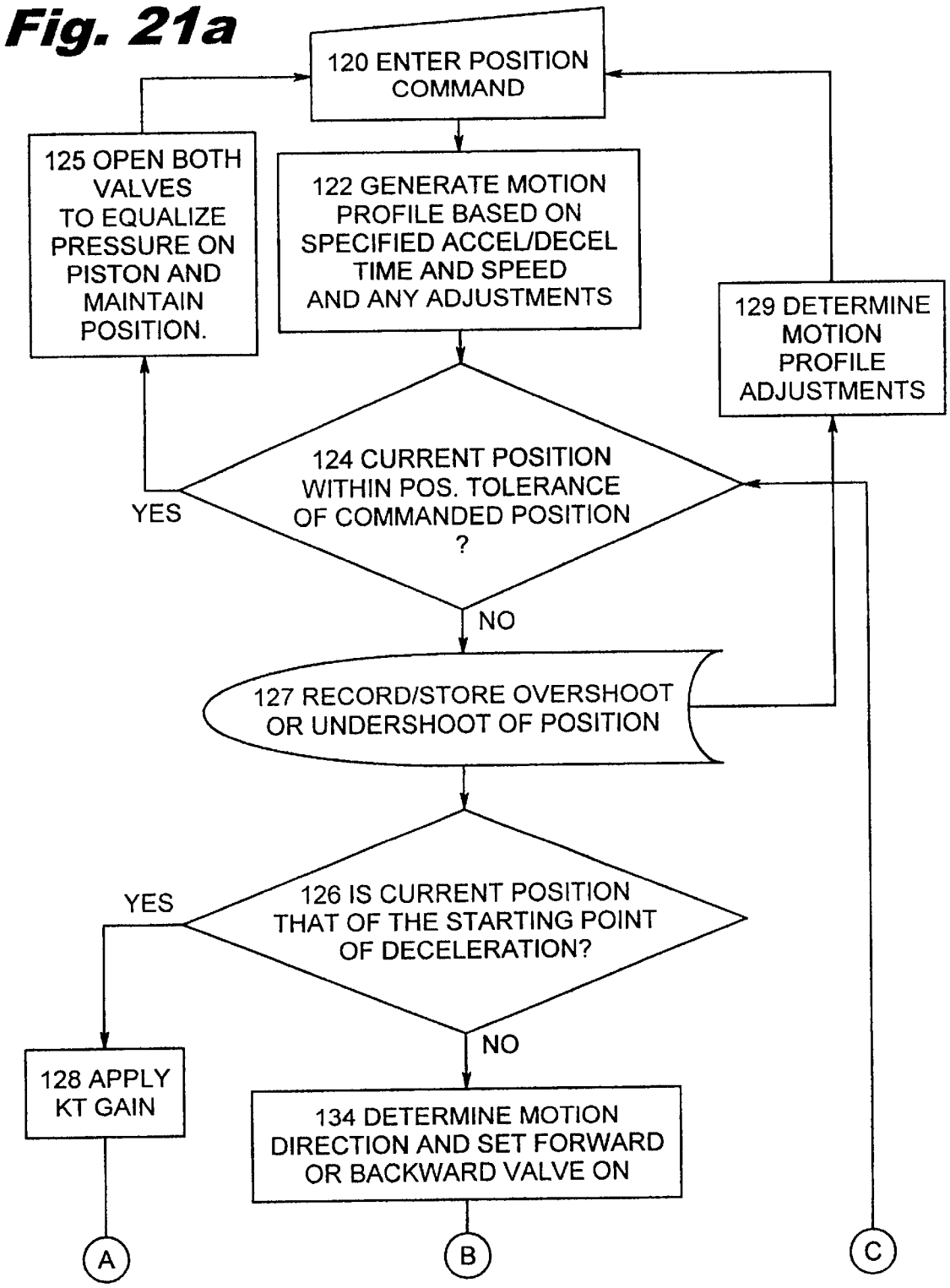
Fig. 21a
120 ENTER POSITION COMMAND
125 OPEN BOTH VALVES TO EQUALIZE PRESSURE ON PISTON AND MAINTAIN POSITION.
122 GENERATE MOTION PROFILE BASED ON SPECIFIED ACCEL/DECEL TIME AND SPEED AND ANY ADJUSTMENTS
129 DETERMINE MOTION PROFILE ADJUSTMENTS
124 CURRENT POSITION WITHIN POS. TOLERANCE OF COMMANDED POSITION ?
YES
NO
127 RECORD/STORE OVERSHOOT OR UNDERSHOOT OF POSITION
126 IS CURRENT POSITION THAT OF THE STARTING POINT OF DECELERATION?
YES
NO
128 APPLY KT GAIN
134 DETERMINE MOTION DIRECTION AND SET FORWARD OR BACKWARD VALVE ON
A
B
C

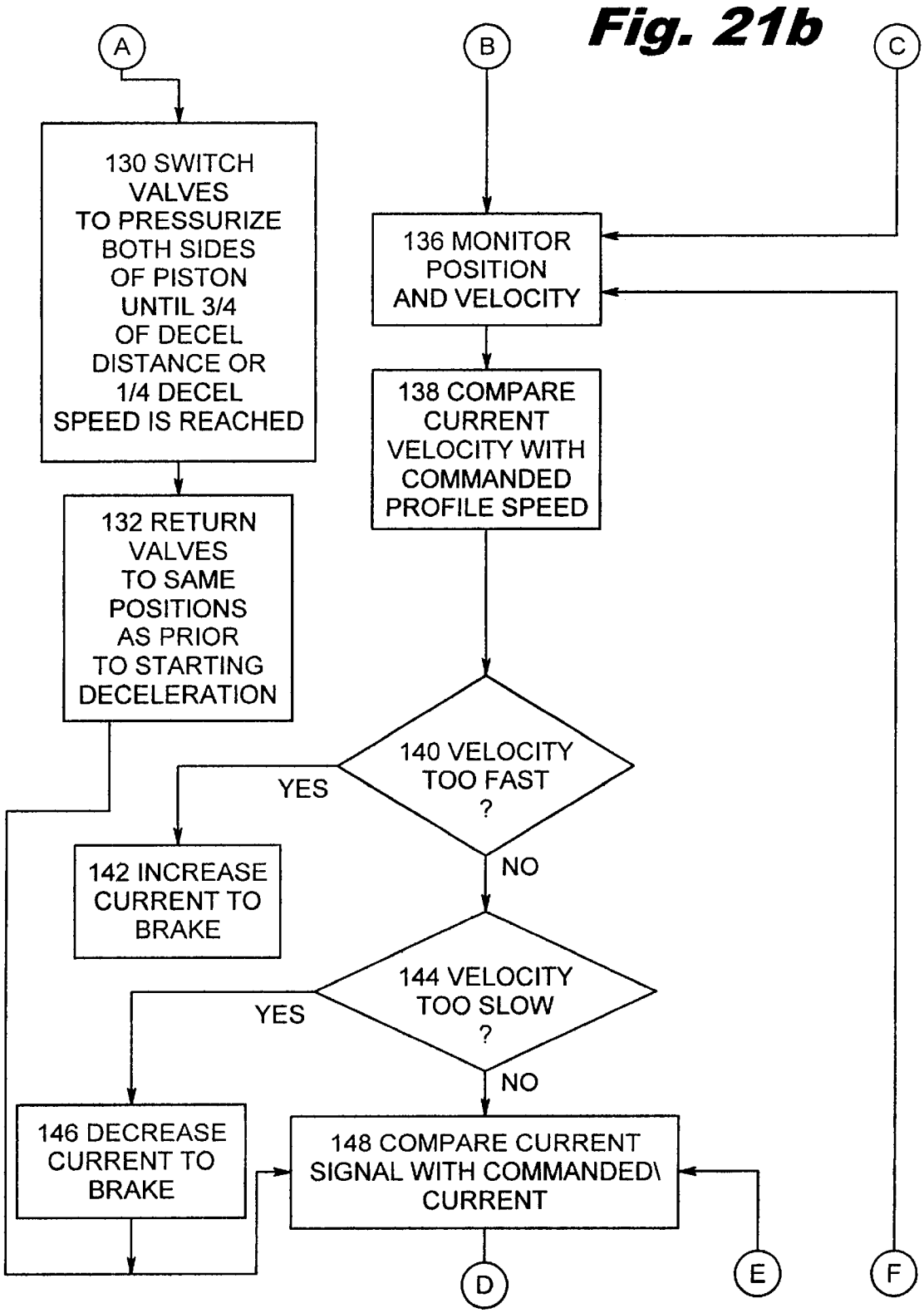
Fig. 21b
A
B
C
130 SWITCH VALVES TO PRESSURIZE BOTH SIDES OF PISTON UNTIL 3/4 OF DECEL DISTANCE OR 1/4 DECEL SPEED IS REACHED
136 MONITOR POSITION AND VELOCITY
138 COMPARE CURRENT VELOCITY WITH COMMANDED PROFILE SPEED
132 RETURN VALVES TO SAME POSITIONS AS PRIOR TO STARTING DECELERATION
140 VELOCITY TOO FAST ?
YES
NO
142 INCREASE CURRENT TO BRAKE
144 VELOCITY TOO SLOW ?
YES
NO
146 DECREASE CURRENT TO BRAKE
148 COMPARE CURRENT SIGNAL WITH COMMANDED\ CURRENT
D
E
F

Fig. 22c

WHERE,

| | |
|---|---|
| Xcmd | -POSITION COMMAND IN COUNTS |
| X | -POSITION IN COUNTS |
| X_linear | -LINEAR POSITION IN USER UNIT |
| Xe | -POSITION ERROR IN COUNTS |
| Ic_c | -CURRENT COMMAND |
| Ie | -CURRENT ERROR |
| Ib_c | -CURRENT FEEDBACK |
| Vb | -VOLTAGE APPLIED TO BRAKE COIL |
| Vfdbk | -FEEDBACK VOLTAGE |
| Ib | -BRAKE CURRENT |
| Tb | -BRAKE TORQUE |
| Fb | -STOPPING FORCE FROM BRAKE |
| F_air | -THRUST FORCE FROM AIR PRESSURE |
| F_fric | -EXTERNAL FRICTION FORCE |
| Fn | -NET FORCE TO DRIVE LOAD |
| Delta PAir | -PRESSURE DIFFERENCE BETWEEN CYLINDER CHAMBERS |
| acc | -CARRIAGE ACCELERATION |
| vel | -CARRIAGE VELOCITY IN COUNTS/SEC |
| vel_e | -VELOCITY ERROR IN COUNTS/SEC |
| vel_cmd | -VELOCITY COMMAND IN COUNTS/SEC |
| A_piston | -CYLINDER PISTON AREA |
| R_pulley | -PULLEY PITCH RADIUS |
| K_torque | -BRAKE TORQUE CONSTANT |
| K_fdbk | -CURRENT FEEDBACK CONSTANT |
| K_adc | -ANALOG TO DIGITAL CONVERSION CONSTANT |
| K_iPWM | -PWM DUTY CYCLE CONSTANT |
| Ks | -VELOCITY CONTROL GAIN |
| Kp | -PROPORTIONAL GAIN |
| Ki | -INTEGRAL GAIN |
| L | -BRAKE COIL INDUCTANCE |
| R | -BRAKE COIL RESISTANCE |
| s | -LAPLACE TRANSFORM OPERATOR |

PRECISION SERVO CONTROL SYSTEM FOR A PNEUMATIC ACTUATOR

CLAIM TO PRIORITY

The present invention claims priority to two co-pending U.S. Provisional patent applications, the first of which is application No. 60/161,875, filed Oct. 27, 1999, entitled "Pnuematic Servo System For A Linear Actuator," and the second of which is application No. 60/240,765, filed Oct. 17, 2000, entitled "Pnuematic Servo System," both of which are hereby incorporated by reference.

FIELD OF THE INVENTION

The present invention relates generally to the field of control systems for pneumatic actuators. More specifically, the present invention relates to a servo control system that provides precise and repeatable control of a pneumatic actuator.

BACKGROUND OF THE INVENTION

Mechanical actuators are used in a variety of industrial applications to move machine elements from one position to another. There are three different ways to power the movement of an actuator, electrically, hydraulically or pneumatically. Electrically powered actuators are used in situations requiring precise control and repeatability. An electrically powered actuator such as a screw drive or belt drive system powered by a rotary servo motor system has the ability to move at different speeds and to stop at any location along the entire length of the stroke of the actuator. Unfortunately, electrically powered actuators are prohibitively expensive for applications involving moving large loads or moving loads at rapid speeds. Hydraulically and pneumatically powered actuators, on the other hand, use a fluid (oil for hydraulics vs. air or gas for pneumatics) to provide a substantial force to a piston that moves inside a chamber and is connected to the actuator. Consequently, hydraulic and pneumatic actuators can move large loads and can move those loads at rapid speeds if desired. Hydraulic and pneumatic actuators also tend to be more durable than electrical actuators.

While hydraulic actuators are well suited for many applications, their use is limited to those environments where oil can be used as part of the machine. For many applications, it is often not practical to utilize oil as the fluid to power an actuator. Pneumatic actuators also tend to be less expensive than hydraulic actuators or electrical actuators. The problem is that pneumatic actuators are much more difficult to precisely control than electrical actuators or even hydraulic actuators. Consequently, most pneumatic actuators are designed to position the actuator at only two stop positions, one at each end of the stroke of the actuator where the end of the chamber, a stopper or the like serves to physically stop the travel of the piston, thereby positioning the actuator at one of these two stop positions. This kind of two stop pneumatic actuator is controlled simply by supplying pressurized air to one side of the piston until the piston reaches the end of the stroke.

To control a pneumatic actuator to stop at positions other than the ends of the stroke of the actuator, the most common technique is to supply air at different pressures to both sides of the piston. Initially, this differential pressure will start the piston moving in a direction from the side with the higher pressure to the side with the lower pressure. Once the piston is moving, this differential pressure is reversed to cause the piston to stop moving. Ideally, the differential pressures can be applied to cause the piston to start and stop exactly at any desired location along the stroke of the actuator. In reality, adjusting the differential pressure to achieve the delicate balance required to precisely control the stop positions of the actuator is quite difficult due at least in part to the compressibility of the air or gas that is used as the fluid to power and control the actuator. These problems are compounded in situations involving changing loads, long stroke lengths or vertically-oriented stroke directions, or in situations where the pressure of the air or gas used to power the actuator is not tightly controlled.

The most common way of adjusting the differential pressure for this kind of pneumatic actuator is by controlling a variable valve or pair of variable valves, which are sometimes referred to as proportional valves or servo valves. Examples of control systems developed for differential pneumatic actuators that use proportional valves to control the differential pressure are described in U.S. Pat. Nos. 4,481,451, 4,666,374, 4,790,233, 4,819,543, 5,154,207 and 6,003,428 and German Patent DE 3313 623 A1. Other variations on controlling a differential pneumatic actuator are described in U.S. Pat. No. 4,878,417 which varies the proportional flow of the fluid in response to measurements from an accelerometer and U.S. Pat. No. 5,424,941 which uses a control system that converts differential pressure into a differential mass flow of the air that moves the piston in an attempt to minimize the problems caused by the compressibility of air.

An alternative technique for controlling the differential pressure of a pneumatic actuator is to use pulse width modulation (e.g., different widths of control pulses) to control the supply of pressurized air to both sides of the piston. Instead of turning a servo valve part way on to control the rate that air flows through the valve, pulse width modulation controls the rate by quickly turning the valve on and then off such that the average time the valve is on is equivalent to the proportional setting of a valve turned part way on for the same period of time. Examples of this pulse width modulation technique are described in U.S. Pat. Nos. 4,628,499, 4,763,560 and 4,907,493. U.S. Pat. No. 4,741,247 describes a very slow version of a pulse width modulation scheme where a series of step volumes of air are introduced into the chamber one at a time in order to move the piston a distance equal to the step volume.

Various attempts have been made over the years to address the problems caused by using air as the fluid to power a pnuematic actuator. One approach has been to use some form of a brake to assist in stopping the piston or the actuator. German patent DE 2,327,387 describes an early use of an electromagnetic friction brake to stop a pneumatic actuator. This patent uses a conventional proportional servo valve to control the differential pressure. Once the actuator passes by a predetermined starting point for braking, the electromagnetic friction brake is applied intermittently to slow the piston down until it is moving at a much slower speed, at which time the brake is applied continuously to completely stop the actuator.

One of the problems with using a brake; however, is that the brake surface will wear down with repeated use and this results in variability in how accurately the system operates over time. U.S. Pat. No. 4,106,390 describes a pneumatic linear actuator where a pneumatic mechanical brake is activated in a braking cylinder separate from but connected to the piston to prevent wear directly on the piston. The pneumatic mechanical brake is only applied to stop the actuator after a three-stage series of air braking decelerations are performed by operating solenoids in response to output signals generated by a sequence generator.

Other types of brakes have also been used as part of a control system for a pneumatic actuator. U.S. Pat. No. 4,932,311 describes a pneumatic actuator having a magnetic rotary brake coupled to the piston by a ball screw shaft. A two-stage braking scheme based on a target braking speed is used to control the stopping locations of the piston. Once the piston passes the location where braking has been programmed to start, either or both an air braking arrangement and the magnetic brake may be applied at different periods along a braking process in either an intermittent or a continuous mode to keep the speed of the piston on target with a calculated braking speed. By attempting to control the speed of the actuator to match the calculated braking speed, the patent seeks to regulate the pneumatic actuator in a way that can tolerate and compensate for changes in the system, including changes in the brake.

A recent example of a controllable pneumatic actuator that uses a rotary proportional magnetic brake is described in PCT Publ. No. WO 00/53936. Both a simple control system and a sophisticated control system are described. In the simple control system, differential pressure is applied though a three-position solenoid valve to drive the pneumatic actuator until it is within a defined distance (Ax) on either side of the desired stopping position that is referred to as a tolerance band. Once inside this tolerance band, the three-position valve is set to a neutral position where no pressurized air is applied to either side of the piston and the proportional magnetic brake is used to stop the actuator. If the load cannot be stopped within the tolerance band it will overshoot the desired stopping position and a reverse thrust must be applied to move the load back into the tolerance band. The problems with the simple control system are that with large loads and speeds where the kinetic energy is high and with system friction present, it becomes difficult to deal with the compressed air required to overcome the system friction and start the load moving and then stop the load moving in time to keep it within the tolerance band. This latter problem is a very undesirable problem known as hunting where the actuator goes back and forth about the desired stopping position or in this case, the defined tolerance band, before finally being stopped.

The sophisticated control system described in this PCT application attempts to solve the problem of hunting in those cases where the kinetic energy of the load being moved is greater than the braking force of the magnetic brake. In this case, the control system calculates a shut down point that will be prior to the desired stopping point based upon the kinetic energy of the system and the available braking force. The shut down point represents the exact time that the system will shut down the differential pressure applied to the actuator and start the magnetic brake. The control system allows a user to input a desired velocity profile for the actuator and uses a low level brake signal to maintain that velocity at the programmed desired velocity up to the shut down point. While the calculation of a shut down point based on kinetic energy may be helpful in reducing the hunting problem of the simple control system, it does not address the real world problems of precision and repeatability in accurately positioning the actuator at a desired stopping position. To be effective, the calculation of the shut down point requires precise knowledge about the mass of the load and the variability of the braking force. Even if precise knowledge of these values can be programmed into the control system, this sophisticated control system is unable to accommodate changes in loads during an operation or changes in the remaining parts of the system due to wear or variance.

In spite of these various attempts, the control and use of pneumatic actuators has been unable to match the precision and repeatability of electrically powered actuators. The goal of being able to program a pneumatic actuator in the same way that an electrical actuator is programmed is well known, but has yet to be achieved. Ideally, a pneumatic actuator could be controlled merely by setting a desired motion profile and/or stopping position and then relying on a servo control system to use positional feedback to guarantee that those results will be achieved. If this were possible, pneumatic actuators could be used in a variety of situations that up to now have been the exclusive domain of electrical actuators. Unfortunately, the number of variables that must be controlled in a pneumatic system, and especially the variabilities caused by the compressibility of air, have frustrated the many attempts to realize this goal.

Because of the complexities and variables involved in operating a pneumatic actuator, most existing control systems are highly individualized to the particular pneumatic actuator and typically require the operator to program the actuator by programming control values for the system in terms of encoder values, pulses, sequences or other units that have complicated relationships to a desired position or velocity. For those control systems which utilize servo systems, the operator must program a very large number of gains in an attempt to fine-tune the control system for a given application. While it may be possible to fine-tune the programming of a given pneumatic actuator with this very large number of gains or adjustments to perform adequately under the known conditions for that given application, even the existing control systems for pneumatic actuators that use servo systems are unable to compensate for situations involving changing loads, long stroke lengths or vertically oriented stroke directions. For this reason, existing control systems for pneumatic actuators limit their performance claims to certain defined conditions, such as limits on the ability to change loads, and always express tolerances in terms of percentages of the stroke length as a way to hide repeatability errors associated with the variability of larger volumes of air that are involved in longer stroke lengths.

It would be desirable to provide an easily programmable servo control system for a pneumatic actuator that could effectively control the operation of the pneumatic actuator to match the precision and repeatability of electrical actuators, even under changing loads, long stroke lengths or vertically oriented stroke directions and that did not require tightly controlled air supplies and expensive servo valves to accomplish this precise servo control.

SUMMARY OF THE INVENTION

The present invention is a precision servo control system for a pneumatic actuator that has a piston positionable over a stroke of the pneumatic actuator using a supply of pressurized gas. A brake and a sensor system are operably connected to the actuator and to the servo control system. The servo control system operates to initiate the forward thrust from the pressurized gas to move the piston along the stroke. When the piston reaches a deceleration point along the stroke as preferably determined by a programmable motion profile, the servo control system initiates a reverse thrust from the pressurized gas while maintaining the forward thrust and simultaneously begins to selectively apply the brake to stop the piston within a predetermined tolerance of a desired stopping position. The precision servo control system is easily programmable in a manner similar to that of a control system for electrical actuators with respect to both the motion profile and the limited number of gains of the control system. The precision servo control system can maintain the predetermined tolerance even under changing loads, long stroke lengths or vertically oriented stroke directions. The precision control servo system utilizes simple two position valves, instead of complex and expensive servo valves, to regulate the pressurized gas. The precision servo control system achieves positional repeatability to predetermined tolerance that is a fixed value, regardless of the stroke length.

Preferably, the precision servo control system allows a user to input a desired motion profile for the actuator and uses a low level brake signal to limit the acceleration to the desired acceleration and velocity of the programmed motion profile until the piston reaches the deceleration-point. Preferably, the brake is a proportional magnetic brake that produces increasing braking torque with increasing current applied to the brake. At the deceleration point, the precision servo control system continues to apply gas pressure to the forward side of the piston and also applies an equal and opposite gas pressure to the backward side of the piston. Because these two pressures are equivalent and opposite, they operate to effectively cancel out any contribution of the pressurized gas in the system after the deceleration point. The active application of the same pressurized gas to both the forward and reverse sides of the piston guarantees that there will be no complicated interaction of a reduction of pressures during the deceleration period.

In addition, the precision servo control system also monitors for a predetermined condition after the deceleration point at which the reverse thrust of pressurized gas applied to the backward side of the piston will turned off. The predetermined condition represents the point at which the precision servo control system first determines that either a defined percentage of a distance from the deceleration point to the desired stopping position has been reached or that there has been a defined percentage reduction in the velocity of the piston. The predetermined condition is selected such that the momentum of the load carried by the piston will be sufficiently small enough that it can be accurately controlled by the brake. Removing the reverse thrust at this point insures that the actuator will have the necessary forward momentum to arrive at the desired position without any jerking or stopping of the actuator. In the event that the momentum of the load carried by the piston does cause an overshoot, the precision servo control system locks the brake, then removes the forward thrust and applies the reverse thrust, after which the brake is slowly released to return the piston to the desired stopping position.

Unlike the existing control systems that rely purely on positioning the piston by adjusting the pressure of the column of air on each side of the piston through use of servo control valves or PWM techniques, the precision servo control system of the present invention can use relatively inexpensive directional valves. More importantly, there is no need for the pressurized gas supply to be closely regulated. This means that the precision servo control system of the present invention can tolerate contaminated gas lines and other changes over time in the pressurized gas supply system because the same pressurized gas is supplied to both sides of the piston during the deceleration period. Because of this equal and opposite application of pressure, the characteristics of the gas supply on each side of the piston cancel each other out. As a result, the servo precision control system of the present invention does not need to create complicated higher orders control functions to compensate for the very complicated characteristics of a compressible and changeable gas supply.

In a preferred embodiment, the precision servo control system is programmed utilizing the standard control parameters of a servo-system including: (1) proportional gain, KP; (2) integral gain, KI; and (3) derivative gain, KV. The proportional gain, KP, is the position error gain that determines how sensitively the control system will respond to the position error (difference in command and actual position). The integral gain, KI, is the position error integral gain that determines how the control system responds to accumulated position error while the piston is approaching the target position. The derivative gain, KV, is the speed error gain that determines how effectively the controller/drive 100 responds to the speed error while the piston is in motion. All three of these control parameters are standard control loop gains for a servo system for an electrically powered actuator. In addition to these standard control loop gains, the precision servo control system preferably uses a deceleration compensation path that enters into effect after the braking point. The deceleration compensation path uses a control parameter beyond the standard control loop gain parameters of a servo system for an electrically powered actuator. This control parameter is a deceleration current constant gain, KT that is used to set the minimum brake current while decelerating the load carried by the actuator. The KT gain is used to adjust for position overshoot, position undershoot, and deceleration profile linearity when the actuator approaches the target position. Unlike the complex and higher order control schemes that have been attempted to accommodate for all of the variables in a pneumatic actuator system, the present invention is capable of accurately and repeatably controlling the positioning of a pneumatic actuator with just these four gain parameters KP, KI, KV, and KT.

DETAILED DESCRIPTION OF THE PREFERRED EMBODIMENT

To better understand the present invention, various ways in which control systems have been used to control the position of a pneumatic actuator will be described and then compared to the way in which the precision servo control system of the present invention provides for precise control and repeatability of positioning a pneumatic actuator. The graphs presented in FIGS. 1–6 are presented for the purpose of demonstrating the various concepts embodied by the present invention as compared to other control systems for pneumatic actuators and are not graphs of actual physical data collected from these systems.

Figure 1:
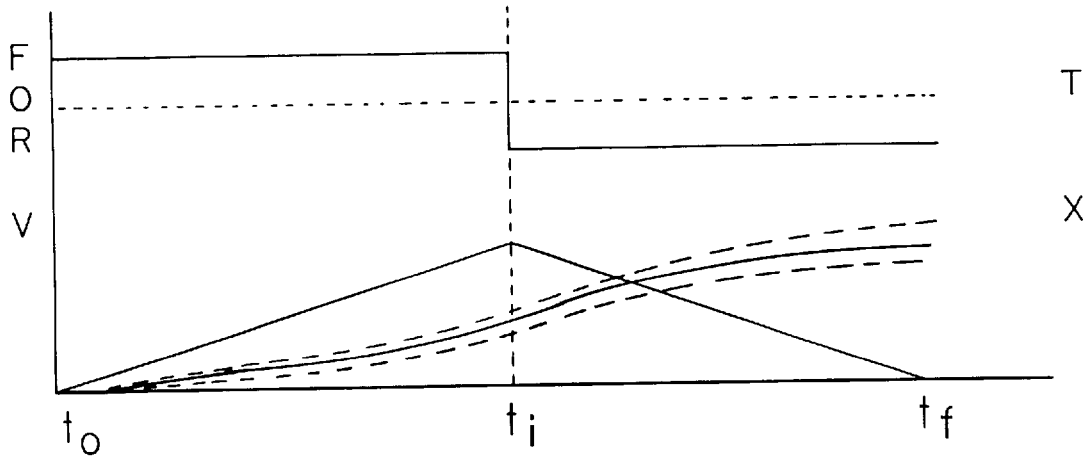
Fig. 1 PRIOR ART
FIGS. 1–4 are graphs showing the operation of various prior art control systems for pneumatic actuators.

FIG. 1 is a graph showing the relation over time (shown on the x-axis) between the velocity (V) of the piston in a pneumatic actuator, the position (P) of the piston and the idealized thrust (T) of differential air pressure in accordance with a simple prior art control system to control the position of the actuator. The thrust (T) is applied in a forward direction (f) at point $X_0$ to move the piston in a forward direction. At point $X(t_i)$ the differential pressure is changed and the thrust (T) is applied in a reverse direction (r) to stop the piston at point $X(t_f)$. If there were no variables in this system, the point $X(t_i)$ could be easily calculated and the ability to control the actuator to stop at point $X(t_f)$ would be simple. Unfortunately, there are a large number of variables that can affect the system and the chances are very small that the actuator will actually stop at point $X(t_f)$. The challenge of getting the actuator to stop at or near the same desired stopping point when the process is repeated is even more difficult. The theoretical or ideal curve that the piston should follow in this system is shown in the solid line. The dotted lines show how the piston is more likely to behave in real world conditions. It will be seen that the type of simple control system shown in FIG. 1 is not a true servo control system because there is no process to feed information about how the piston is moving back into the process of controlling the differential pressure. The only control provided by this simple control system is to change the location of point $X(t_i)$ where the thrust of the differential pressure is reversed.

Figure 2:
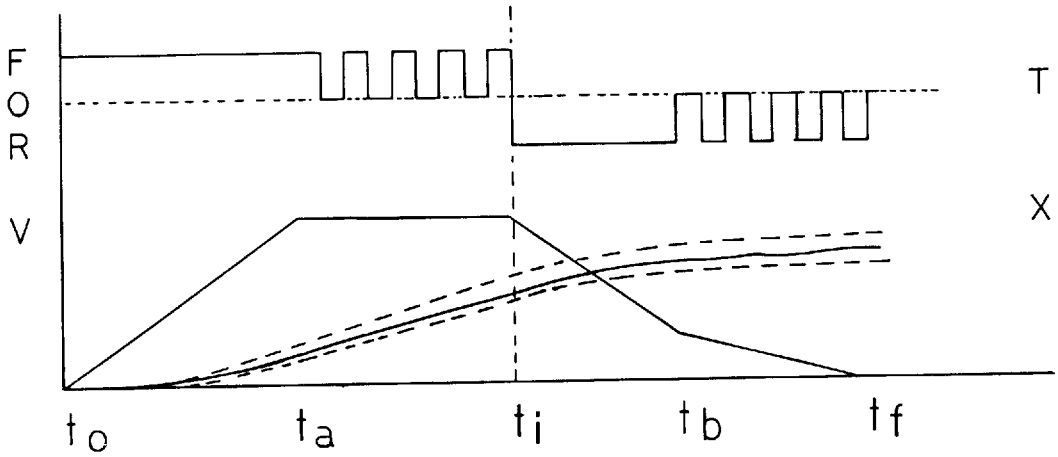
Fig. 2 PRIOR ART

FIG. 2 is a graph similar to FIG. 1 that shows a conventional servo control system that uses a servo valve or pulse width modulation (PWM) technique to change the thrust (T) in response to sensor information about how the piston is moving. Like the simple control system of FIG. 1, there is a point $X_i$ where the orientation of the thrust is reversed. Unlike FIG. 1, position and/or velocity information is used by the control system to adjust the amount of forward or reverse thrust (T) that is applied. For example, once the velocity of the piston reaches a defined value ($V_1$), the control system can adjust the PWM signal at point $X(t_a)$ to reduce the thrust in an attempt to maintain the velocity at the defmed value ($V_1$). A similar situation happens with a servo control valve, only the value of the thrust (T) would be controlled by altering the amount of positive thrust delivered via the servo valve. In a similar manner, the control system can control how much reverse thrust is applied to stop the piston. The control system will adjust the PWM signal as point $X(t_b)$ to try to slow the piston down so that it will stop at the desired location $X(t_f)$. While this process has a better chance of stopping the piston near the desired location $X(t_f)$ than the control system of FIG. 1, the variables due to the compressibility of air, system friction, system wear, air pressure changes, changing loads, long stroke lengths or vertically oriented stroke directions are simply too much for this servo control system to be able to control. Again, the dashed lines show how the actuator of this system is likely to behave under real world conditions.

Figure 3:
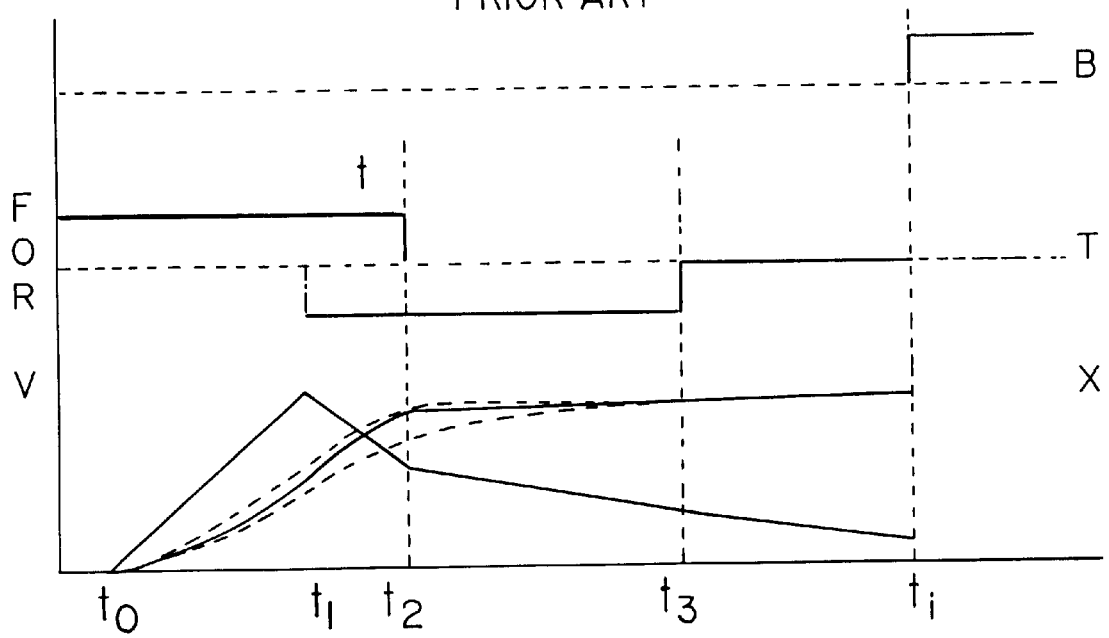
Fig. 3 PRIOR ART

FIG. 3 is a graph similar to FIG. 1 but also showing a brake (B) applied to stop the piston after using the three-stage air braking decelarations as described in U.S. Pat. No. 4,106,390. In this system, a sequence generator outputs different control signals to control a series of solenoids according to a programmed sequence. First, a solenoid is opened to provide a forward air pressure to the piston to start the piston moving at point $X(t_0)$. At the same time, the reverse side of the piston is opened to the atmosphere through a controlled relief valve to create a constant differential pressure that moves the piston at a constant low velocity. When the piston advances a programmed number of counts beyond a sensor at location point $X(t_i)$ the sequence generator changes the solenoid to create a first deceleration that occurs during a time period (t) when air pressure is applied to both the forward side (top line) and reverse side (bottom line) of the piston. After the time period (t) which can expire at any number of different positions $X(t_2)$ depending upon the velocity (V) originally achieved by the system, the sequence generator again changes the solenoid to effect a second deceleration where the solenoid is changed to provide a reverse air pressure and the forward side of the piston is opened to the atmosphere. When the piston advances a further distance $X(_3)$, a third deceleration to a very low velocity is accomplished by slowing opening the reverse side of the piston to the atmosphere. Finally, after a final movement at the very low velocity to the target position, another solenoid is opened to apply the pneumatic mechanical brake (B) to the brake cylinder to stop the actuator at location $X(t_f)$. This control system provides a greater accuracy than the other control systems, but does so at the significant cost of dramatically increased time for movement of the piston due to the very slow velocities used in the final stages of approaching the desired location. Even with this system, there would be variances as reflected by the dashed lines that do not allow for precise or repeatable control of the piston.

Figure 4:
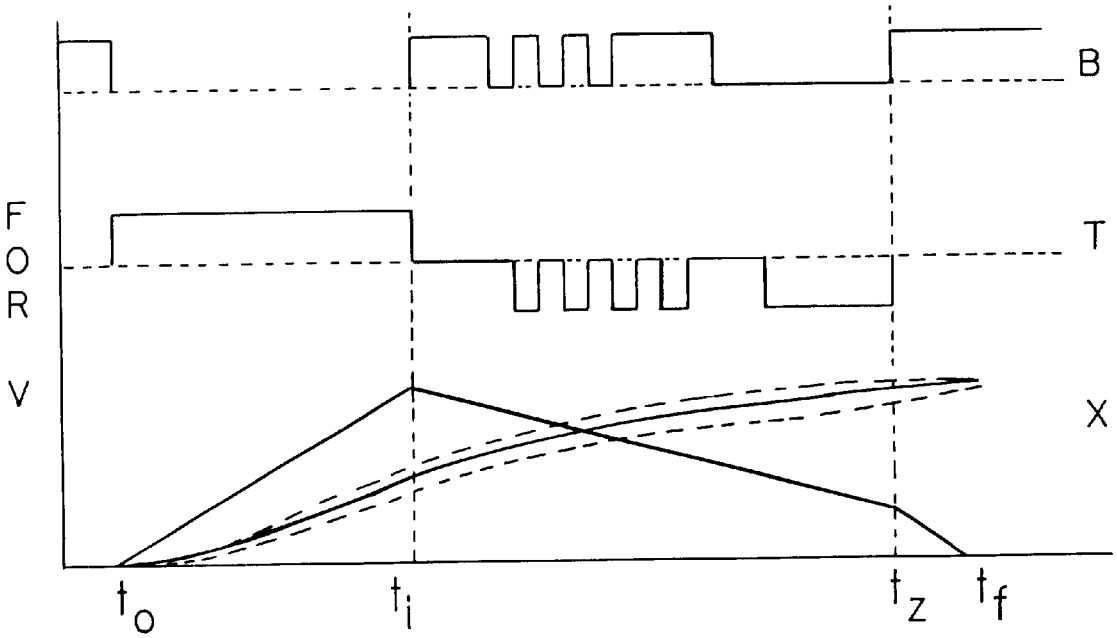
Fig. 4 PRIOR ART

FIG. 4 is a graph similar to FIG. 3 showing the control system and brake arrangement as described in U.S. Pat. No.

4,932,311. A two-stage braking scheme based on a target braking speed is used to control the stopping locations of the piston. An encoder on the ball screw shaft determines the position of the piston, from which a speed of the piston is calculated. To start movement of the actuator at point $X(t_0)$, air pressure is supplied to a forward side of the piston and the magnetic brake (B) is released. Once the piston passes the location $X(t_i)$ where braking has been programmed to start, either or both an air braking arrangement and the magnetic brake may be applied at different periods along a braking process in either an intermittent or a continuous mode to keep the speed of the piston on target with a calculated braking speed. The continuous mode of the air braking arrangement uses a conventional simple differential pressure technique where forward pressure is turned off and reverse pressure is applied. The intermittent mode of the air braking arrangement uses a variation on the pulse width modulation control technique to create a differential pressure by pulsing a control signal to a switch to intermittently apply a reverse air pressure to slow the piston down to match the target braking speed. In a similar manner, the magnetic rotary brake can be applied in a continuous mode or can be applied in an intermittent mode where the brake is pulsed off and on to slow the piston down to match the target braking speed. Once the actuator position is in a final section at $X(t_z)$ close to the target position $X(t_f)$, an output stop signal is sent to the magnetic brake (B) to stop the piston. If the actuator is actually stopped at the target position $X(t_f)$, then air pressure is made neutral on both sides of the piston. Otherwise, forward air pressure is reapplied to the piston and the entire braking process is repeated. By attempting to control the speed of the piston to match the calculated braking speed, this system seeks to regulate the pneumatic actuator in a way that can tolerate and compensate for changes in the system, including changes in the brake. In practice, however, the combined use of both the mechanical braking arrangement and the air braking arrangement simply increases the number of variables that must be programmed into and handled by the control system, thereby complicating the control arrangement rather than simplifying it. Again, the dashed lines represent expected real world behavior under varying conditions.

Figure 5:
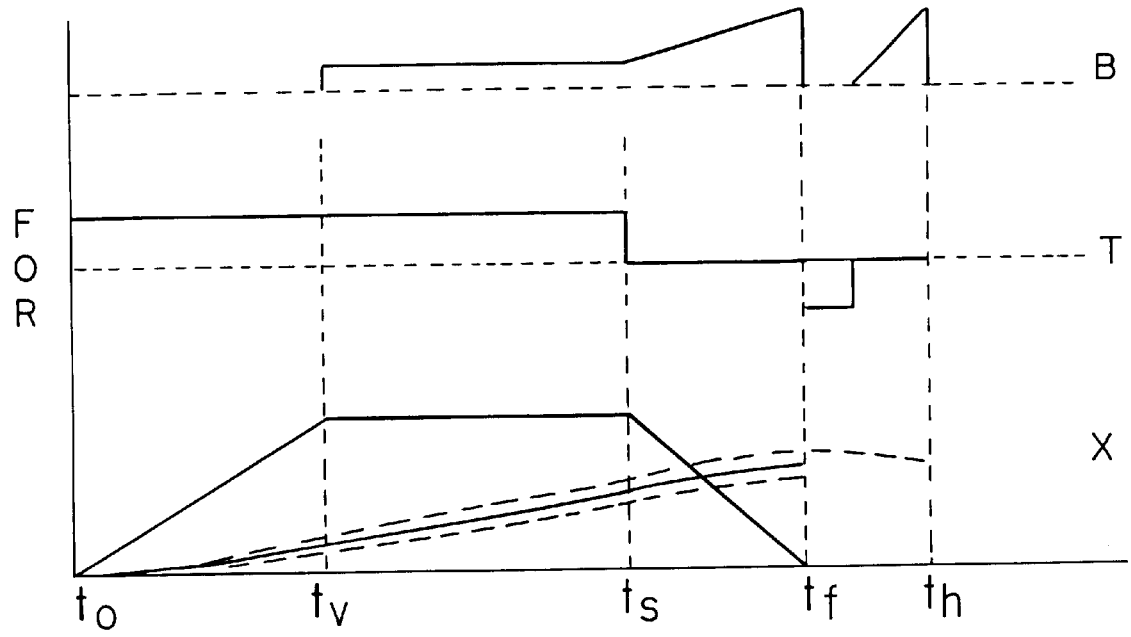
FIG. 5 is a graph showing the operation of a control system for a pneumatic actuator that utilizes a proportional magnetic brake.
Figure 8:
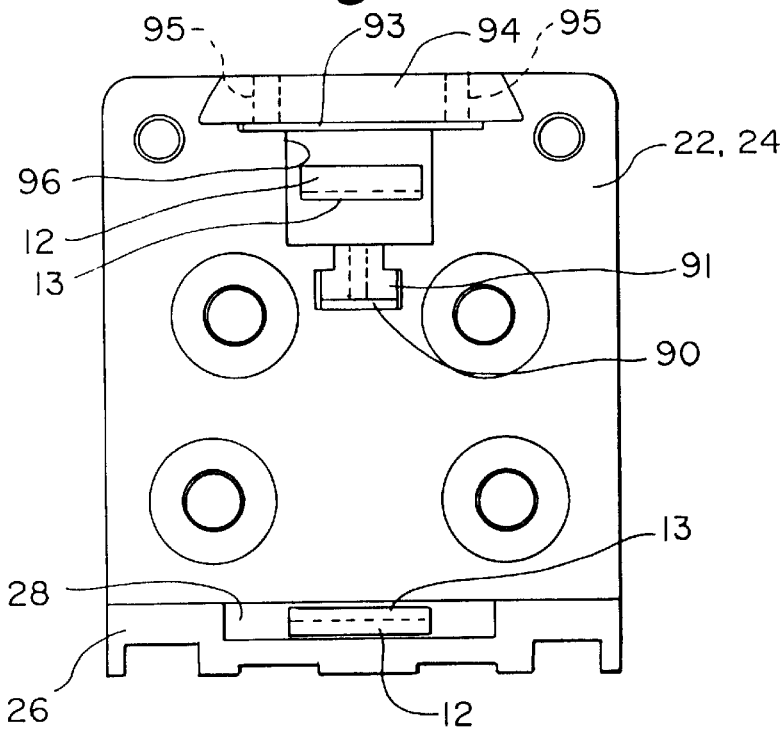
FIG. 8 is an end view as viewed along the line 8—8 of FIG. 7 of the rodless cylinder of FIG. 7 showing one of the sealing heads and its relationship to portions of the cylinder and positioning means.

FIG. 5 is a graph similar to FIG. 3 showing the control system and magnetic proportional brake arrangement as described in PCT Publ. No. WO 00/53936. It should be understood that the discussion of this control system is not intended as any form of an admission that this system may be prior art to the precision servo control system of the present invention. Both a simple and a sophisticated control system are described for this system. Movement is initiated at point $X_0$ by applying a forward differential pressure. The problem with hunting problem using the simple control system is best shown in FIG. 8 of the PCT application and will not be discussed. The sophisticated control system calculates a shut down point $X_s$ that is prior to the desired stopping point $X(t_f)$. This calculation is based upon the kinetic energy of the system and the available braking force according to the equations as described in the PCT application. The shut down point $X(t_s)$ represents the exact time that the system will shut down the differential pressure (P) applied to the actuator and start the proporational magnetic brake (B). As shown, the differential pressure (P) is set to have both the forward and reverse sides of the piston go to a neutral or atmospheric pressure at the shut down point $X(t_s)$. The control system allows a user to input a desired velocity profile for the actuator and uses a low level brake signal to maintain that velocity at the programmed desired velocity between $X(t_v)$ and the shut down point $X(t_s)$. In the event that the proportional magnetic brake does not stop the piston by the desired location point $X(t_f)$, then the system must release the proportional brake and apply reverse thrust to move the piston back toward the desired location point $X(t_f)$. While the calculation of a shut down point $X(t_s)$ based on kinetic energy may be helpful in reducing the hunting problem of the simple control system, if there is an overshoot the control system has no alternative but to reverse thrust to back the piston up to the desired location point $X(t_f)$. Unfortunately, the control system responds to an overshoot in such a way that further hunting is likely because the control system releases the brake before applying the reverse thrust, thereby creating an uncontrolled motion that complicates further positional control.

The control system based on a kinetic energy model also does not address the real world problems of precision and repeatability in accurately positioning the piston at a desired stopping position. To be effective, the calculation of the shut down point requires precise knowledge about the mass of the load and the variability of the braking force. Even if precise knowledge of these values can be programmed into the control system, this sophisticated control system is unable to accommodate changes in loads during an operation or changes in the remaining parts of the system due to friction, wear or variance. Although the challenges presented by variables in the differential air pressure are seemingly addressed by setting both the forward and reverse sides of the piston to a neutral position, it is believed that this actually introduces additional uncontrolled variables into the control process in the form of how the air pressure on both sides of the piston actually changes to the neutral or atmospheric pressure. Because of the extreme importance of mass in determining the kinetic energy model that is used to control the system, it is also questionable as the ability of the system to maintain even this amount of accuracy in the event of any significant load change of more than a few percent.

Figure 6:
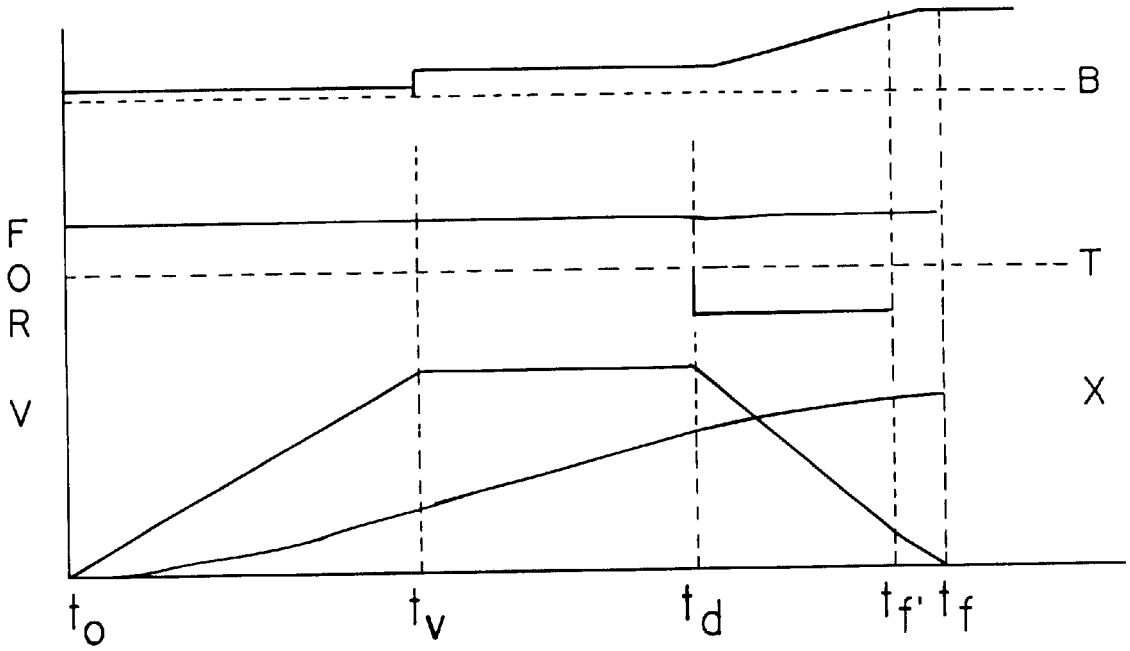
FIG. 6 is a graph showing the operation of a precision servo control system for a pneumatic actuator in accordance with the present invention.

Referring now to FIG. 6, a graph showing the operation of a precision servo control system for a pneumatic actuator in accordance with the present invention will now be described. As with the existing pneumatic control systems, the piston is started moving forward at point $X(t_0)$ by applying a forward differential pressure or thrust. Like existing control systems for electrical actuators, the precision servo control system of the present invention allows a user to input a desired motion profile for the actuator. The precision servo control system preferably uses the brake (B) and feedback information from the sensor system to maintain that motion profile throughout the acceleration and constant velocity portions of the motion profile. Unlike the shut down point $X(t_s)$ in the system described in FIG. 5, the present invention continues to apply a forward thrust and, starting at point $X(t_d)$,also applies an equal and opposite backward thrust. Because the pressures of these two thrusts are equivalent and opposite, they operate to effectively cancel out any contribution of the pressurized air in the system during the proportional braking period from point $X(t_d)$ to just prior to the desired position at point $X(t_f)$. The active application of the same pressurized gas to both the forward and reverse sides of the piston guarantees that there will be no complicated interaction of a reduction of pressures during the deceleration period.

In addition, the present invention preferably monitors for a predetermined condition represented by the point $X(t_f')$ just prior to the desired stopping position at point $X(t_f)$. The predetermined condition represents the point at which the precision servo control system first determines that either a defined percentage of a distance from the braking point to the desired stopping position has been reached or that there has been a defined percentage reduction in the velocity of the piston. Once the point $X(t_f')$ has been reached, the reverse thrust of pressurized gas applied to the reverse side of the piston is turned off. The predetermined condition is selected such that the momentum of the load carried by the piston will be sufficiently small enough that it can be accurately controlled by the brake. Removing the reverse thrust at the point $X(t_f')$ insures that the actuator will have the necessary forward momentum to arrive at the desired position at point $X(t_f)$ without the need for any jerking, stopping or crawling of the actuator. In the event that the momentum of the load carried by the piston does cause an overshoot, the precision servo control system locks the brake, then removes the forward thrust and applies the reverse thrust, after which the brake is slowly released to return the piston to the desired stopping position. In the event that $X(t_f')$ is set equal to $X(t_f)$, the servo precision control system will maintain both forward and reverse thrust until the desired stopping point is reached.

Unlike the existing control systems that rely purely on air braking through use of servo control valves or PWM techniques, the precision servo control system of the present invention can use relatively inexpensive directional valves, such as a pair of two-position valves or a single three-position valve. More importantly, there is no need for the pressurized gas supply to be closely regulated. This means that the precision servo control system of the present invention can tolerate contaminated gas lines and other changes over time in the pressurized gas supply system because the same pressurized gas is supplied to both sides of the piston during the decelaration period. Because of this equal and opposite application of pressure, the characteristics of the gas supply on each side of the piston cancel each other out. As a result, the precision control system does not need to create complicated higher orders control functions to compensate for the very complicated characteristics of a compressible and changeable gas supply.

The precision servo control system for a pneumatic actuator of the present invention provides a low-cost pneumatic position and velocity control system relative to electric motion systems, without the setup and control challenges of traditional pneumatic servo systems. The present system is applicable to virtually all types of pneumatic motion devices including linear actuators such as rod actuators, rod slide actuators or rodless actuators, as well as rotary actuators. The precise control afforded by the present invention provides for a positional repeatability of at least +/−0.1 inches and preferably up to +/−0.010 inches independent of the stroke length of the pneumatic motion device, the pneumatic supply pressure, or the valve CV (a number expressing the ability of a fluid to flow under pressure difference or pressure drop, also referred to as flow capacity or flow coefficient). As a result, a user of the system is able to define a motion profile for the pneumatic motion device by defining a motion profile in a manner consistent with that of servo systems for electrical actuators.

I. System Components

Figure 7:
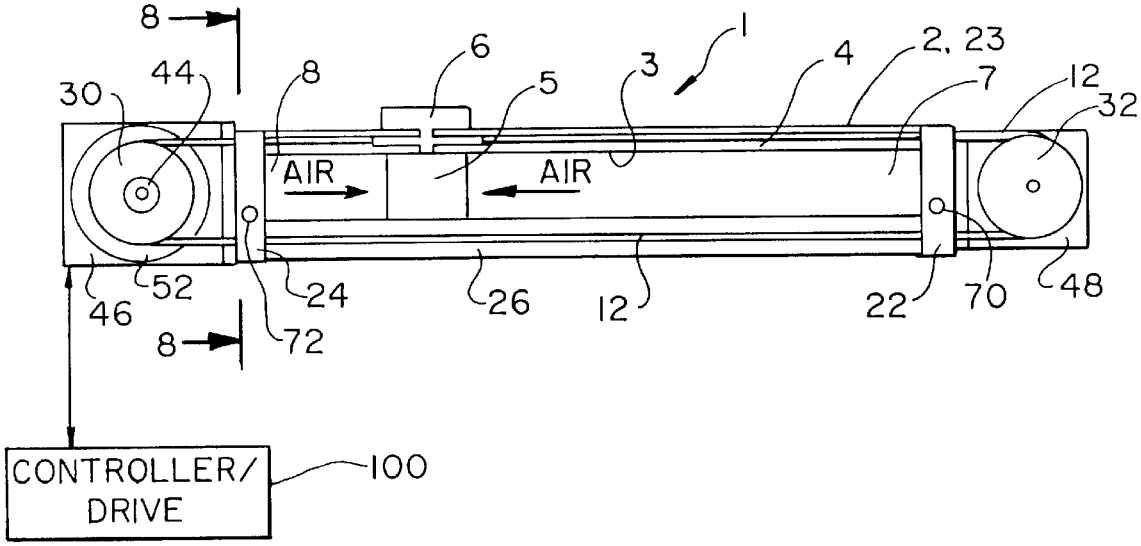
FIG. 7 is a side view, with portions removed, of a pneumatic position and velocity control system as applied to a linear actuator, i.e., a rodless cylinder, in accordance with the present invention.

While the system of the present invention is applicable to virtually all pneumatic motion devices, for clarity the system will be described below with reference to a specific pneumatic motion device, i.e., a linear actuator. With reference to FIG. 7, system 1 of the present invention generally comprises the linear actuator 2, with an integral brake 52 and sensor system, preferably an encoder 44, and a programmable controller/drive 100 that is in electrical communication with the brake 52 and encoder 44. System 1 with linear actuator 2 may be used in both horizontal and vertical applications.

I.A. Linear Actuator—Rodless Cylinder

The linear actuator 2 has a support member and a driven member moveable along such support member. The driven member includes mechanism that connects to a load. One such linear actuator or motion device is commonly referred to as a rodless or pressure cylinder. In general, a rodless cylinder comprises an elongated cylinder body and an internal bore and an elongated slot extending through the cylinder body wall. A piston is reciprocally moveable within the bore in response to the introduction and exhaust of pneumatic pressure on opposite sides of the piston and a carrier or transfer bracket is connected to and moveable with the piston for connection to a load. Various embodiments of these types of rodless cylinders exist in the art. Examples of such rodless cylinders are illustrated in U.S. Pat. No. 4,545,290 and U.S. Pat. No. 5,555,789 both of which are incorporated herein by reference. The general structure of such a rodless cylinder is illustrated in FIG. 7.

With reference to FIGS. 7 and 8, the rodless cylinder in accordance with a preferred embodiment of the present invention includes an elongated cylinder body 2 having an internal bore 3 and an elongated slot 4 extending through the wall of the cylinder body 2. Positioned at opposite ends of the cylinder body 2 are sealing heads 22 and 24 to define a pair of pressure chambers 7 and 8. A reciprocally moveable piston 5 is positioned within the bore 3 and is adapted for reciprocal movement back and forth within the bore 3 in response to fluid pressure introduced into or exhausted from the fluid pressure chambers 7 and 8. Specifically, the fluid pressure chamber 7 is defined between the piston 5 and the sealing head 22, while the fluid pressure chamber 8 is defined between the piston 5 and the sealing head 24. A carrier or transfer bracket 6 is connected with the piston 5 and extends through the cylinder slot 4 where it is connected with a load (not shown). Sealing means in the form of an elongated sealing band 90 (FIG. 8) is provided to seal the slot 4, and thus the pressure chambers 7 and 8, on opposite sides of the piston 5 as the piston 5 moves within the bore 3. The sealing band 90 is retained in the sealing heads 22 and 24 by a retaining member 91 and one or more set screws 92. A magnetic dust band 93 can, if desired, also be provided to seal the top of the slot 4. The dust band 93 is retained in the sealing heads 22 and 24 by a retaining member 94 and the set screws. The details of such sealing means and dust cover as well as the detailed structure of the rodless cylinder as described above is well known in the art as exemplified by U.S. Pat. Nos. 4,545,290 and 5,555,789. Although the pressure used to drive the piston 5 within the cylinder bore 3 can be any type of fluid pressure, it is preferably pneumatic or air pressure.

Figure 9:
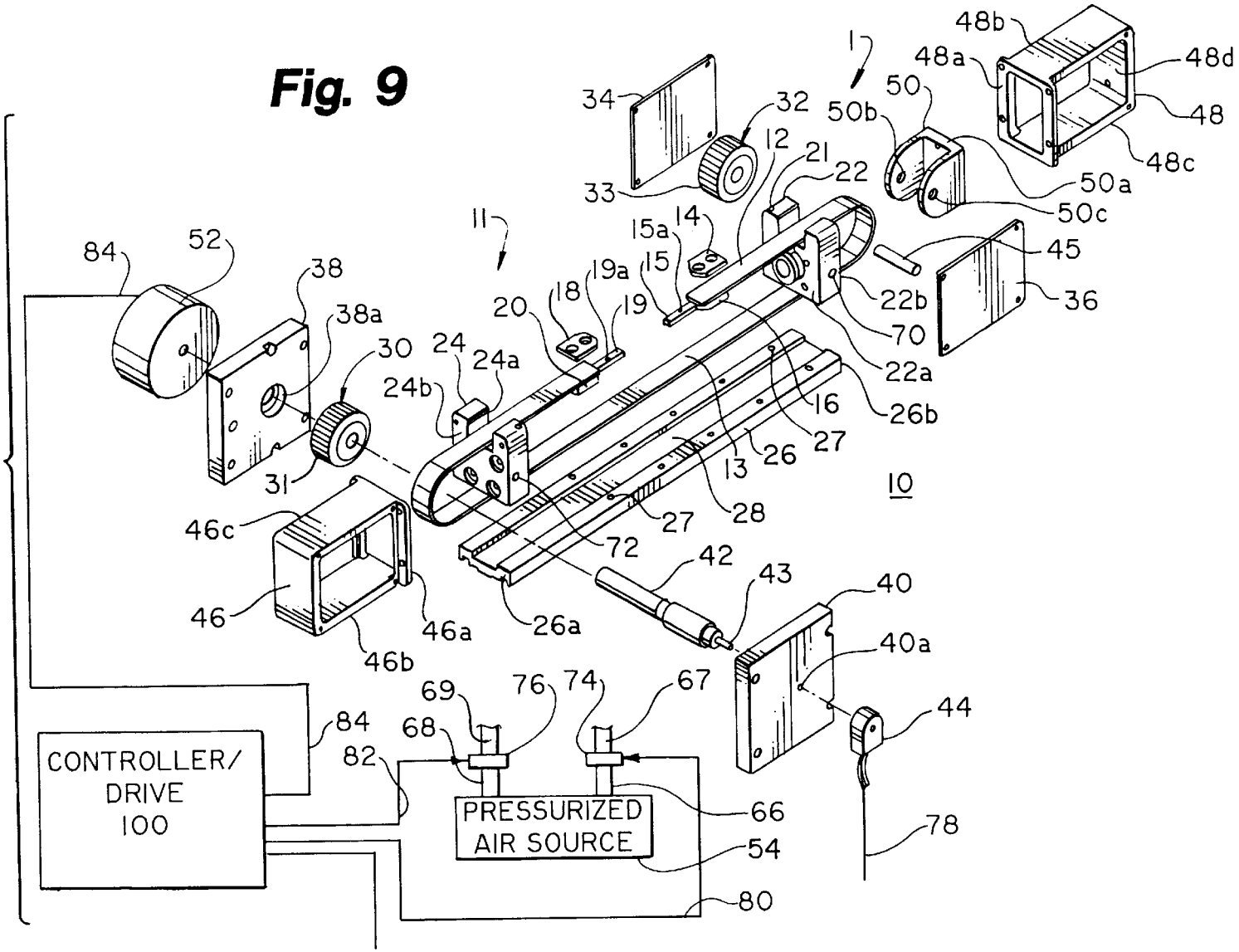
FIG. 9 is an exploded isometric view of a system for implementing an embodiment consistent with the present invention, including portions of a rodless cylinder and associated structure and a computer for controlling operation of the rodless cylinder.
Figure 10:
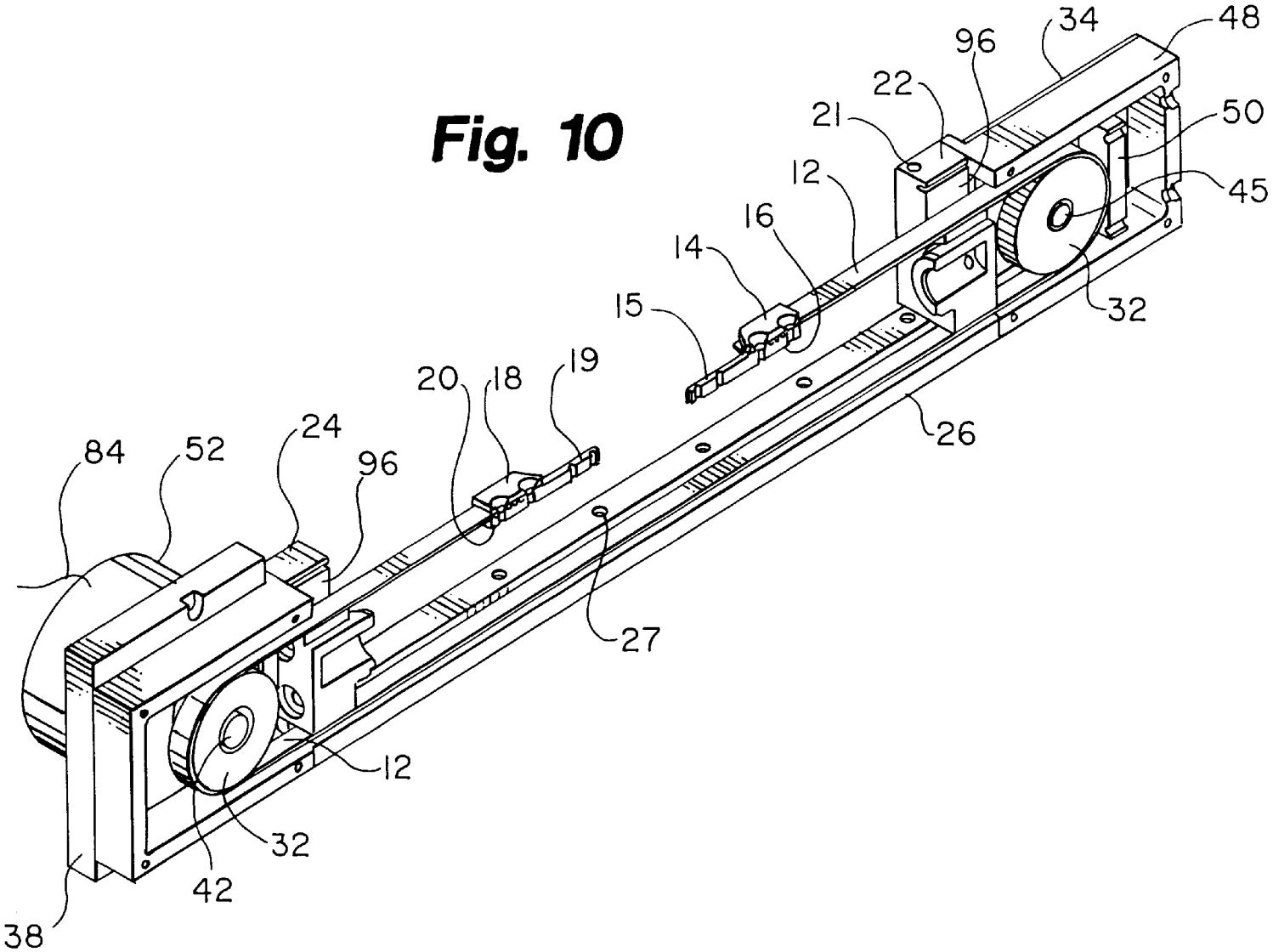
FIG. 10 is an isometric view, cut in half, of the positioning assembly for a rodless cylinder in accordance with the present invention.
Figure 11:
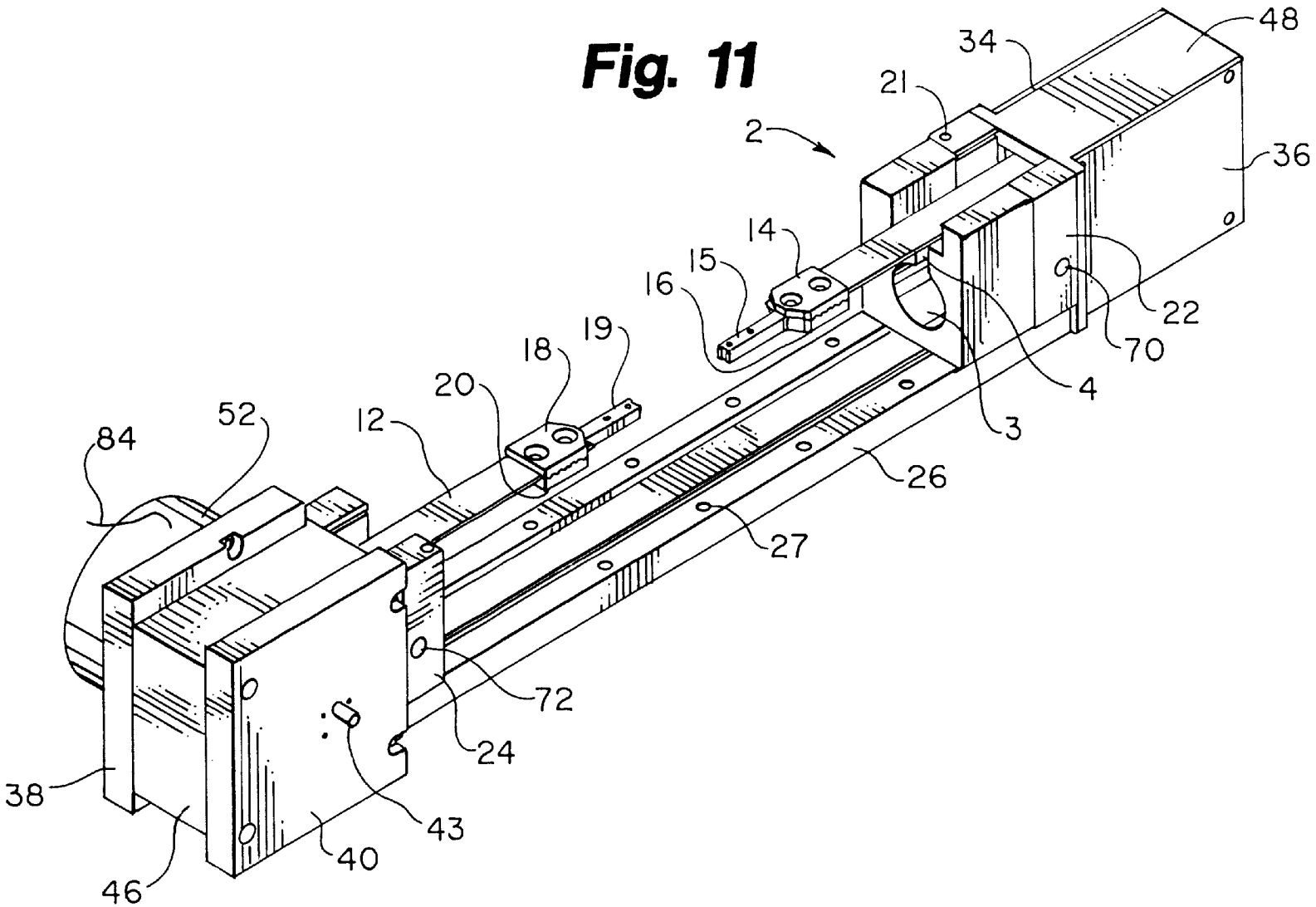
FIG. 11 is an isometric view of an assembled assembly of FIG. 9 showing a portion of the cylinder.

FIG. 9 is a diagram of a system 10 including an exploded view of a positioning assembly 11 usable with the rodless cylinder as described above for controlling the movement and positioning of the piston 5 (FIG. 7) and thus the load.

The assembly 11 includes an elongated flexible member shown in the preferred embodiment as a belt 12. The belt 12 is typically constructed of a rubber or synthetic material and may include a ridged or toothed inner surface as shown by the ridges 13. Although the member 12 is flexible to permit it to travel around-the pulleys as described below, it is also preferably non-extendable. In the preferred embodiment, a pair of belt clamp portions 18 and 20 are attached to one end of belt 12 through bolts or other types of fasteners and a pair of belt clamp portions 14 and 16 are attached to the other end of belt 12 through bolts or other types of fasteners. The belt clamps 16 and 20 include connector portions 15 and 19, respectively, which fasten to opposite ends of the carrier or transfer bracket 6 (FIG. 1). Preferably, the connector portions 15 and 19 include threaded apertures 15*a* and 19*a* for receiving threaded screws to connect the belt clamps and the ends of the belt 12 to the carrier bracket. A carrier or transfer bracket includes any structure or apparatus moveable with the piston for connecting the elongated flexible member or belt with the piston.

Other types of apparatus or structure for connecting the elongated flexible member or belt 12 with the transfer bracket or piston may also be used. For example, the belt 12 may be an endless belt which is simply clamped or otherwise connected with the transfer bracket. The flexible member may also comprise an endless cable connected to the transfer bracket or a cable with ends connected to the transfer bracket, similar to the belt 12.

The elongated flexible member or belt 12 is connected with a motion conversion device for converting linear movement of the piston into rotary movement. In the preferred embodiment, such device comprises a pair of pulleys 30 and 32 around which the belt 12 travels. Each pulley 30 and 32 preferably includes a plurality of ridges or teeth 31 and 33 for mating with the toothed inner surface of the belt 12. The pulleys 30 and 32 are mounted at opposite ends of the rodless cylinder as shown in FIGS. 7 and 8. In particular, the pulley 32 is rotatably mounted on a shaft 45 which is in turn attached to a mounting bracket 50 within a pair of apertures 50*b* and 50*c*. The mount bracket 50 is generally a U-shaped bracket having a base 50*a* attached to an inner surface portion 48*d* of a pulley housing 48 using bolts or other fasteners. A pair of mounting plates 34 and 36 are attached to opposing sides 48*b* and 48*c*, respectively, of the housing 48 using bolts or other fasteners.

The pulley 30 is rotatably mounted on a rotation shaft 42 which is supported within the housing 46. A pair of mounting plates 38 and 40 attach to opposing sides 46*b* and 46*c*, respectively, of the housing 46. As shown, the mounting plates 38 and 40 include apertures 38*a* and 40*a* for rotatably supporting the shaft 42. One end of shaft 42 is connected with a proportional brake 52 through the aperture 38*a*, while the other end of shaft 42 includes a portion 43 connected to a rotary encoder 44 through the aperture 40*a*. The apertures 38*a* and 40*a* may each include bearings for accommodating rotation of the shaft 42.

Although the pulley 32 may rotate relative to the shaft 45, if desired, the pulley 30 is connected with its shaft 42 for rotation therewith. Thus, rotation of the pulley 30 causes corresponding rotation of the shaft 42. The belt 12 extends around the pulleys 30 and 32 so that rotation of the pulleys causes movement of the belt or piston and movement of the belt or piston causes rotation of the pulleys.

The brake 52 is connected to the shaft 42 for rotation therewith and preferably may be any brake whose braking force is proportional to an input signal or driving force. Alternatively, a non-proportional brake could be utilized with a pulse width modulation control or similar intermittent control technique that can selectively exert a braking force. In the preferred embodiment, the brake 52 is an electrical current proportional brake whose braking force is proportional to an electric current input. More specifically, an example of a current proportional brake usable in the present invention is a Lord Rheonetic magnetic particle brake sold the by Lord Corporation. In the preferred embodiment, the shaft 42 is connected with the brake 52 as an output shaft. Thus, braking forces from the brake 52 are applied to the shaft 42.

The encoder 44 may be any type of encoder capable of providing an output signal indicating the relative position of a piston in a rodless cylinder. In the preferred embodiment, the encoder 44 is a rotary encoder connected with the shaft 42 and functioning to provide a signal indicating the relative angular position of the shaft 42 and thus the linear position of the piston 5 (FIG. 7). An example of a rotary encoder usable in the present invention is a Hewlett-Packard HP HEDS 5500 rotary encoder used with an AMP encoder cable or a Renco RM15 series encoder. Linear encoders may also be used in place of the rotary encoder wherein the linear encoder provides true carrier 6 position instead of the position as determined through movement of the belt 12. Alternatively, other types of sensor systems for detecting position, velocity or acceleration may be utilized with the present invention, such as optical, infrared, photoelectric, laser, microwave, accelerometers or the like.

The pair of opposed sealing heads 22 and 24 are connected to the ends of the cylinder body for sealing the bore 4 in the cylinder 2 and defining the chambers 7 and 8. The front face 48*a* of the housing 48 is connected to the sealing head 22 through bolts or other fasteners. The sealing heads 22 and 24 as well as the cylinder body 2 may be made from a die-cast aluminum or other material. As shown best in FIG. 2, the sealing heads 22 and 24 include a recessed area 96 between the seal member 90 and the dust band 93 to accommodate the belt 12.

As shown best in FIGS. 7–11, a belt containment portion 26 is attached to the bottom of the cylinder body 2 by a plurality of threaded connectors extending through the holes 27. The portion 26, which may be integral to the extrusion of the cylinder body 2, includes a belt channel 28 for accommodating the belt 12. In operation, the belt 12 moves freely within the channel 28 between the portion 26 and the bottom of the surface of the cylinder bottom. Preferably the portion is connected to the cylinder 2 on a side opposite the slot 4 and opposite the carrier bracket.

The sealing heads 22 and 24 include ports 70 and 72, respectively, for receiving pressurized air or other fluid from a pressurized air source 54, and also preferably include an air cushion port 21 for cushioning the movement of the piston 5 as it approaches the end of the cylinder. The air source 54 includes two lines 66 and 68 for providing pressurized air to the valves 74 and 76, and ultimately to the ports 70 and 72 through the lines 67 and 69. The air source 54 is preferably a constant pressure source and valves 74 and 76 are preferably standard directional air valves (no servo-valves are required). The air pressure range is preferably in the 25 to 120 psi range and, more preferably, in the 50 to 100 psi range.

Figure 12:
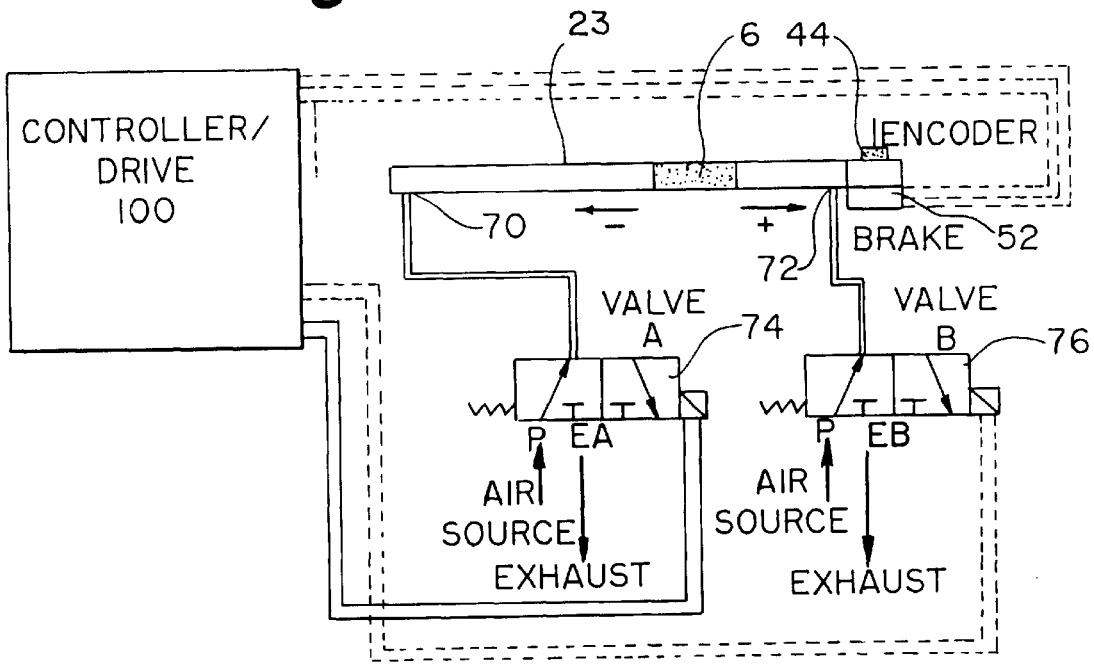
FIG. 12 depicts a first valve configuration that may be used with the system of the present invention.
Figure 13:
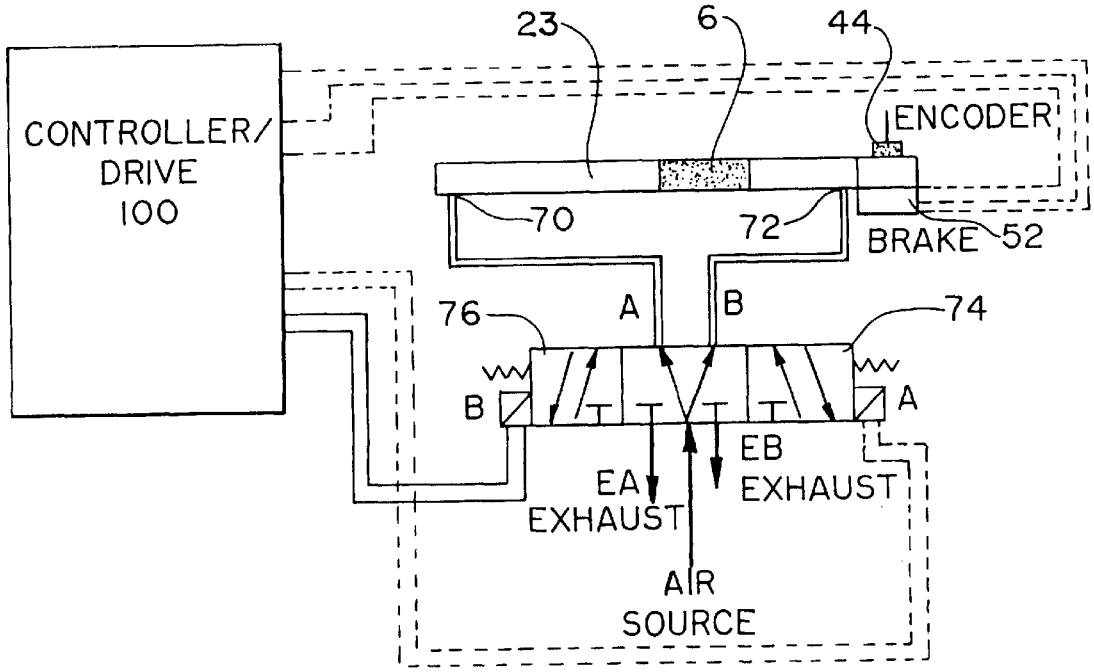
FIG. 13 depicts a second valve configuration that may be used with the system of the present invention.

In a first preferred embodiment, valves 74 and 76 comprise two 2-position 3-way normally open solenoid-actuated valves, as shown in FIG. 12. In a second preferred embodiment, valves 74 and 76 are unitary in the form of a 3-position 4-way spring centered dual-solenoid valve, as shown in FIG. 13. The solenoid valves are preferably selected so as to have a response time of less than 20 milliseconds to minimize the effect the response time has on system 1. The valves 74 and 76 are controlled directly by controller/drive 100 and are preferably mounted in close proximity to cylinder 2; short air line lengths between the valves 74, 76 and cylinder 2 help to optimize the response time of system 1.

For horizontal applications of system 1 with rodless cylinder 2, either the valve configuration of FIG. 12 or the valve configuration of FIG. 13 may be used. When plumbing the rodless cylinder 2, keeping the valves 74 and 76 as close to the cylinder 2 as possible and using air lines of the same length will help to optimize the performance of system 1. Pressurized air source 54 is preferably operated at the minimum supply pressure necessary for the application at hand. This helps to minimize the heat generated by the brake 52, therefore, helping to maximize the application duty cycle.

For vertical applications of system 1, a dual pressure system is preferably used to obtain optimum performance. The dual pressure system may be achieved by using two separate external pressure regulators or a valve with a sub-base mounted pressure regulator. Further, vertical applications are preferably connected by using two separate valves to provide the two separate pressures to rodless cylinder 2 (similar to FIG. 12). Moreover, the brake end of rodless cylinder 2 is preferably mounted at the top in the vertical application to help minimize the chance of slack in the belt 12 at the brake 52. Again, as with horizontal applications, the valves 74 and 76 are preferably mounted as close as possible to cylinder 2 and air lines of equal length are preferably used to help optimize the performance of the system 1. However, different from the horizontal applications, air source 54 is preferably operated at different pressures for each direction of movement to compensate for gravity's effect on the load and to help minimize the amount of brake torque needed.

As shown best in FIG. 9, the valves 74 and 76 in the lines 66 and 68 control the introduction of pressurized air into and exhaustion of air from the ports 70 and 72 and thus the chambers 7 and 8 (FIG. 7). For example, by opening the valve 76, while the valve 74 remains closed, air pressure is provided to the port 72 (and thus the chamber 8) and exhausted from the port 70 (thus the chamber 7) through the closed valve 74. This causes the piston 5 to move away from sealing head 24 (toward the right as viewed in FIG. 7). Likewise, with the valve 74 open and the valve 76 closed, air pressure is provided to the port 70 and exhausted from the port 72. This causes the piston to move away from the sealing head 22 (toward the left as viewed in FIG. 7). With both valves 74 and 76 open, the piston 5 may be held in place by equalizing the pressure in the chambers 7 and 8 on opposite sides of the piston.

I.B. Programmable Controller/Drive

Figure 14:
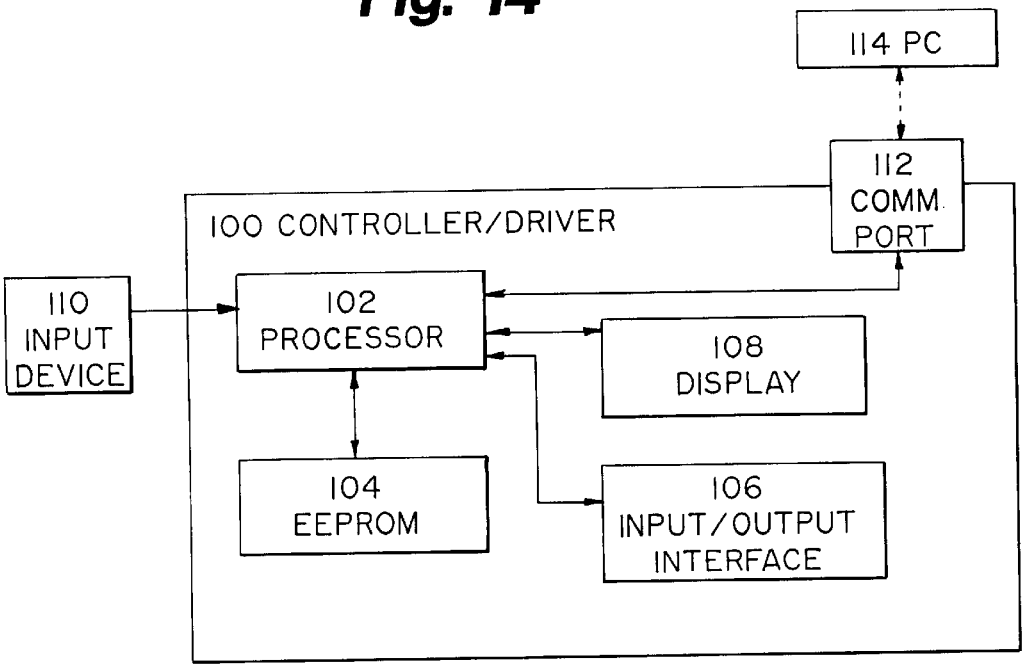
FIG. 14 is a block diagram of a controller/drive of the present invention.
Figure 15:
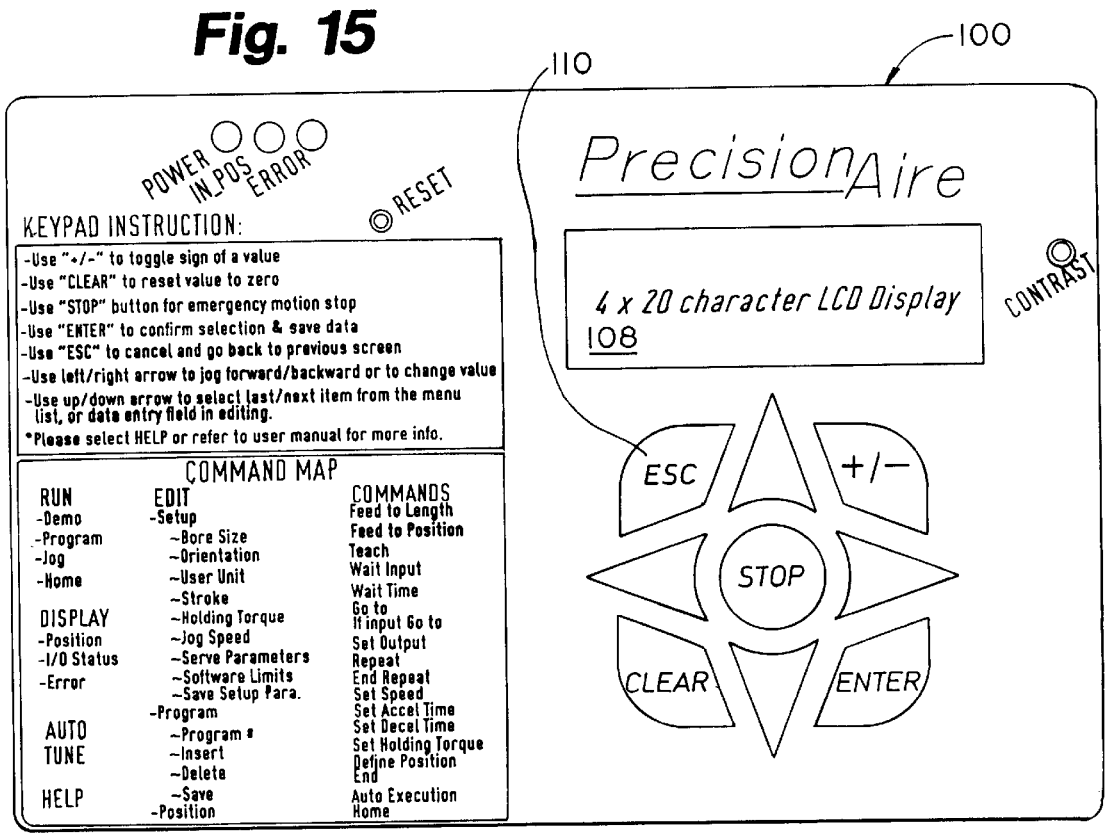
FIG. 15 is a facial configuration of the controller/drive of the present invention.

The programmable controller/drive 100, a block diagram of which is depicted in FIG. 14, generally comprises a processor 102 in communication with a memory storage device 104, and input/output (I/O) interface 106, a display 108, a user-input device 110, and a communication port 112. The processor 102 operates to control the operation of system 1 by executing pre-programmed functions and program(s) stored in the memory storage device 104. In a preferred embodiment, the processor 102 is a digital signal processor (DSP), such as the Texas Instrument TMS320C240. The memory storage device 104 preferably comprises an EEPROM that is capable of storing demo programs and up to 7–256 line programs that can be activated directly, on power-up of controller drive 100, or with an input. The I/O interface 106 preferably provides for electrical connection to each of the solenoids which direct the operation of the valves 74 and 76 (along lines 80 and 82, see FIG. 9) as well as electrical connection to brake 52 (along line 84, see FIG. 9) and to encoder 44 (along line 78, see FIG. 9). Display 108 is preferably in the form of an LCD screen that is unitary with the controller/drive 100 while the user-input device 110 is preferably in the form of a keypad that is also unitary with the controller/drive 100. The communication port 112 is preferably an RS-232 port enabling communication of controller/drive with an external PC 114 for external programming and data collection. Controller/drive 100 is preferably powered from line voltage and therefore does not require an external power supply. A preferred facial configuration of controller/drive 100 is shown in FIG. 15 with the keypad 110 and LCD 108 screen noted.

I.C. Alternative System Components

Figure 16:
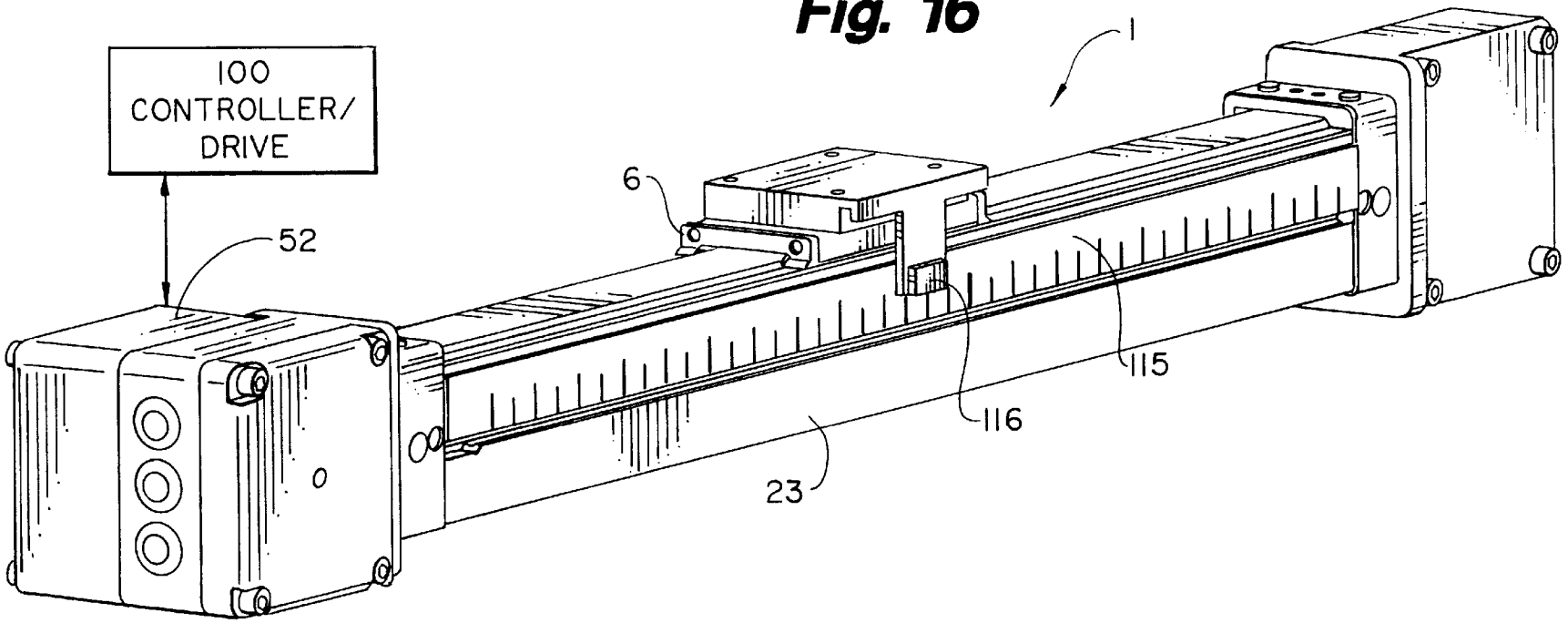
FIG. 16 depicts the system of the present invention wherein a linear encoder is utilized.
Figure 17:
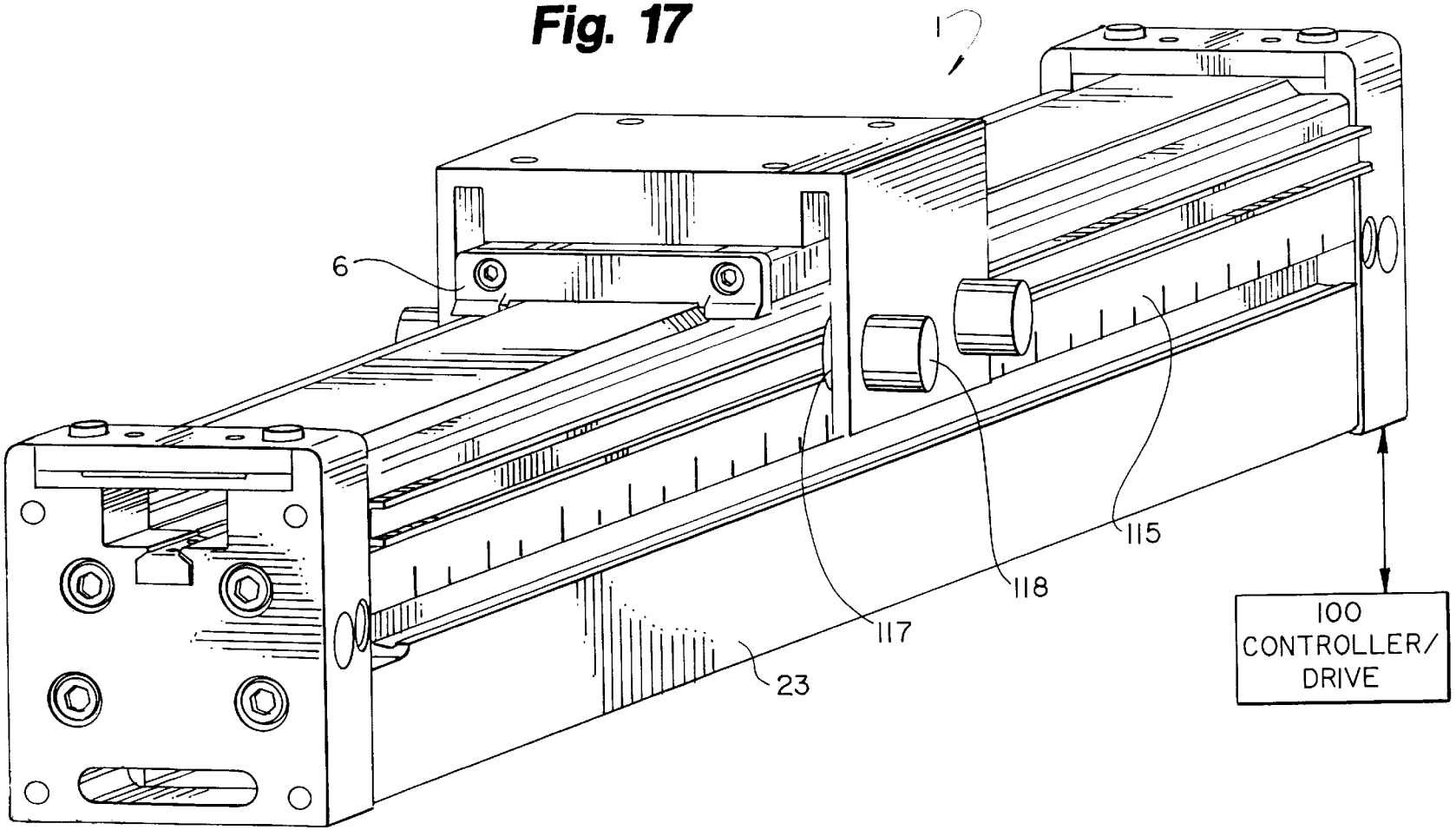
FIG. 17 depicts the system of the present invention wherein a linear encoder and a friction pad braking device is utilized.
Figure 18:
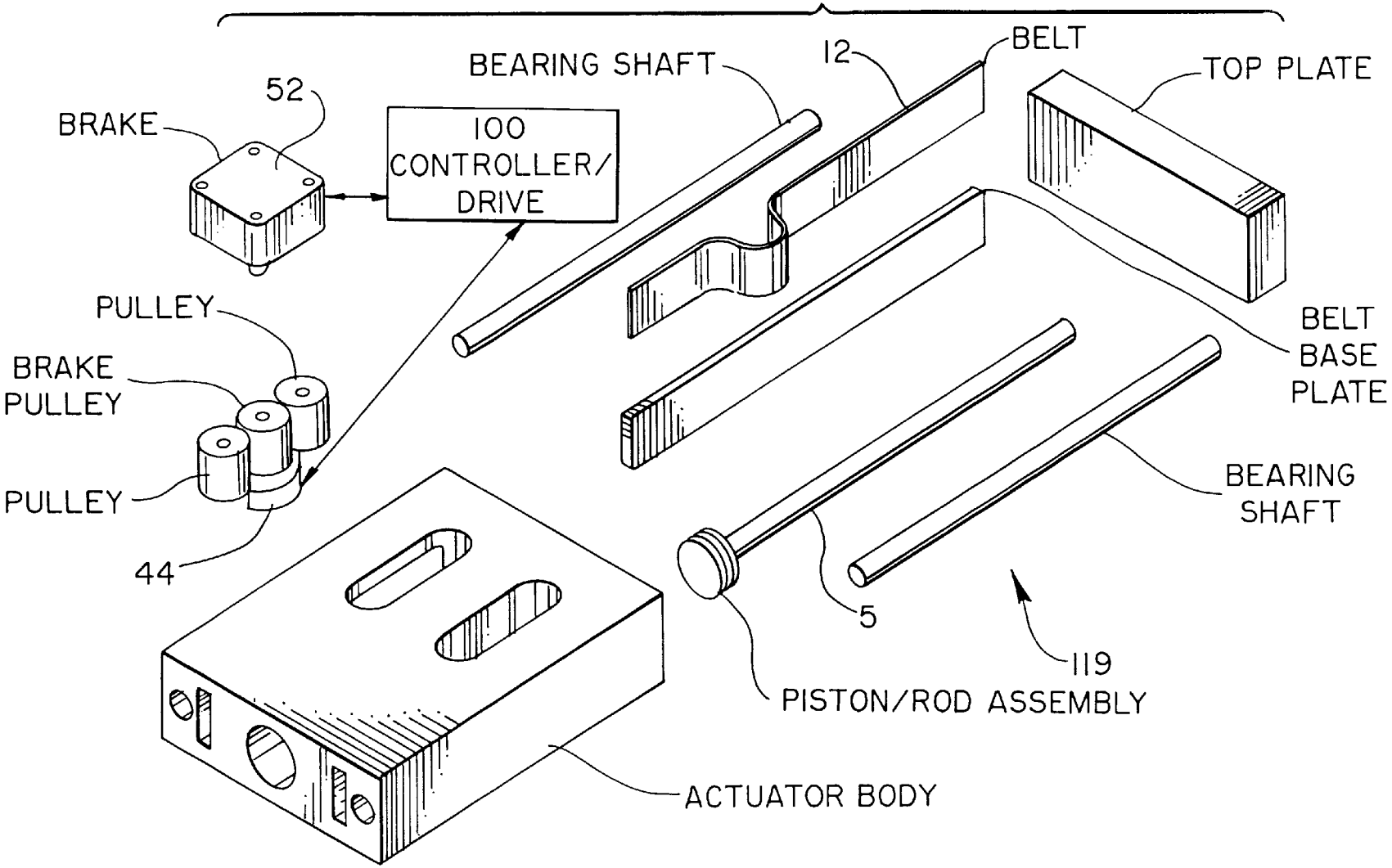
FIG. 18 depicts the system of the present invention wherein a slide rod actuator is utilized.
Figure 19:
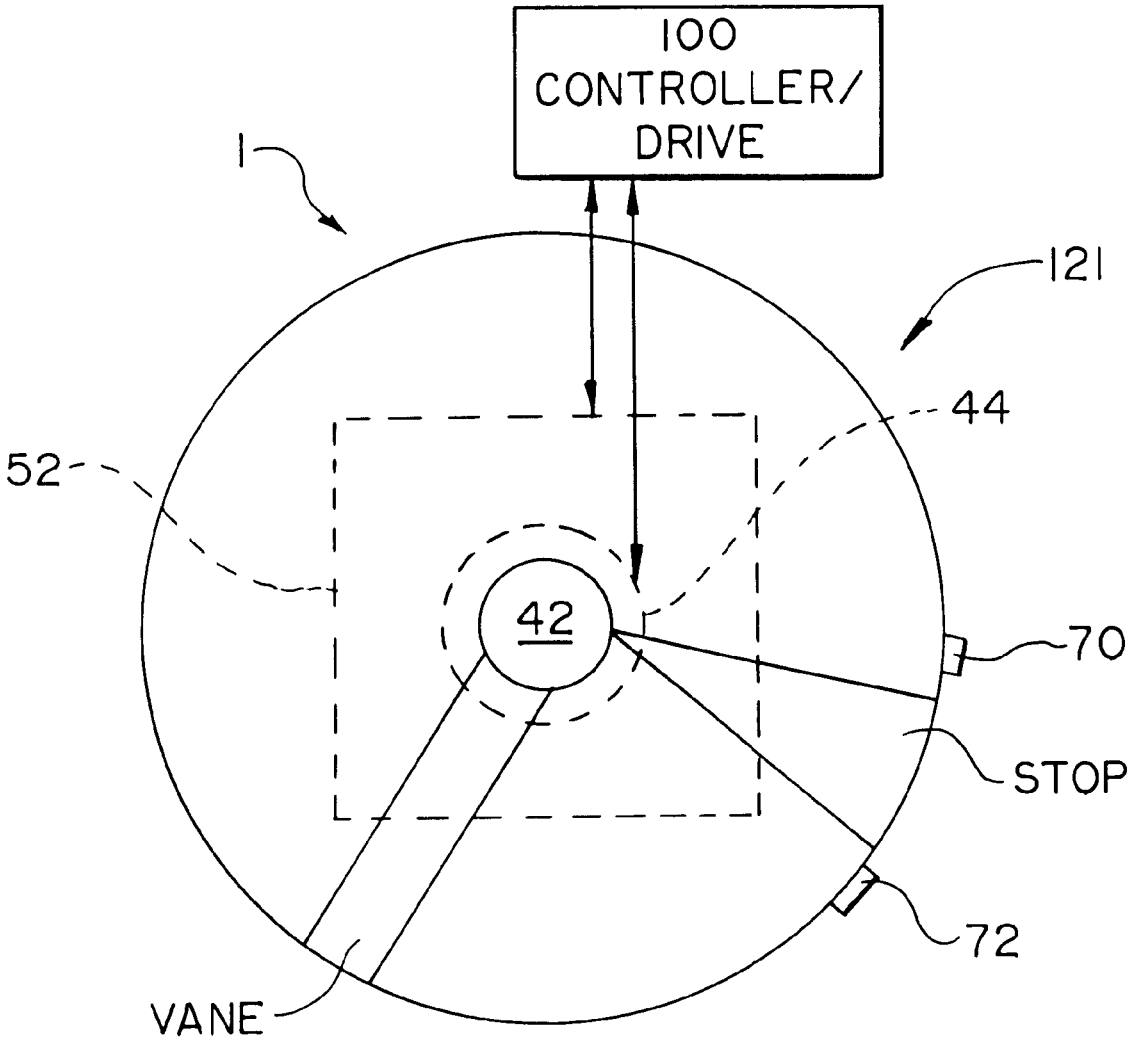
FIG. 19 depicts the system of the present invention wherein a rotary actuator is utilized.
Figure 20A:
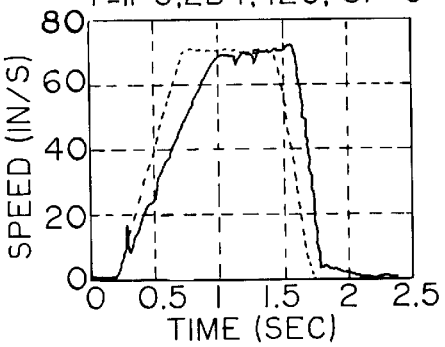
FIG. 20 comprises various graphical examples of motion profiles that may be used by the system of the present invention.
Figure 20B:
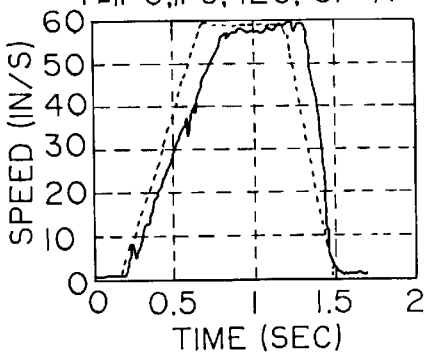
Figure 20C:
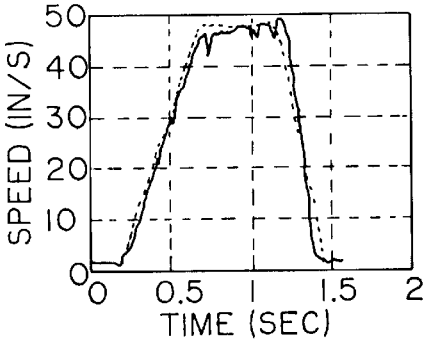
Figure 20D:
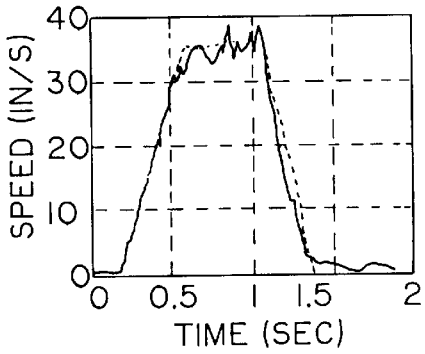

As indicated above, the system 1 may be modified as appropriate to a specific application without departing from the spirit or scope of the invention. By way of non-limiting example, these modifications may include: (1) a rodless cylinder that utilizes a linear encoder 115 placed along the body 2 of the cylinder, as opposed to the rotary encoder 44, wherein the read head 116 of the encoder 115 is attached to the carrier 6, see FIG. 16; (2) a rodless cylinder that utilizes linear, friction pad braking devices 117 on the carrier 6 that are driven by solenoids 118, see FIG. 17; (3) a slide rod actuator 119, see FIG. 18; (4) a rotary actuator 121 utilizing a vane and a stop, see Fig.19.

II. System Operation

In the system comprising a pneumatic motion device, such as the rodless cylinder 2 described above, and the programmable controller/drive 100, the programmable controller/drive 100 operates to control the position and velocity of rodless cylinder 2. Specifically, programmable controller drive receives signals from encoder 44 that reflect the linear position of the piston 5 in the rodless cylinder 2. The position signals are processed based upon a stored motion profile to generate control signals. The controller/drive outputs the control signals to the valves 74 and 76 controlling the introduction and exhaust of pressurized air into and out of the pressure chambers 7 and 8 and to the proportional brake 52 for use in controlling movement of the piston 5. By operating on the position signals from the encoder 44, the controller/drive 100 effectively uses feedback information to precisely control movement of the piston 5 at desired speeds and to the desired positions. The ability to control such movement of the piston 5 permits the use of the system 1 for a wide variety of applications. System 1 may be used for traditional applications, as well as various applications requiring precise and repeatable movement including but not limited to, picking up a load at one position and releasing it at another, commonly referred to as "pick and place."

II. A. System Component Functions

In general, the operation of system 1 may be described as follows, the piston 5 in the cylinder bore 3 is caused to move reciprocally as a result of the selective introduction and exhaustion of air pressure into and out of the pressure chambers 7 and 8. Because the piston is connected with the carrier bracket 6 which is in turn connected to a load, such movement of the piston 5 results in corresponding movement of the load. Also, because the belt 12 is connected at its ends to the bracket 6, movement of the piston results in corresponding movement of the belt 12 around the pulleys 30 and 32. Accordingly, the belt 12 functions to convert the substantially linear movement of the piston 5 to rotary movement of the pulleys 30 and 32, and in particular the pulley 30. By use of the rotary encoder 44 connected to the shaft 42 of the pulley 30, the angular position of the shaft 42 can be monitored by processor 102. Because the angular position of the shaft 42 is directly related to the linear position of the piston 5 by virtue of the belt 12, the rotary encoder 44 can be utilized to monitor the movement and positioning of the piston 5 and thus the connected load.

Specific operation of system 1 is defined by a user-programmed motion profile that is entered through the user-input 110 or external PC 114 and stored in the memory storage device 104. The motion profile is defined by a programmed move distance, a maximum speed, acceleration time, and deceleration time for piston 5 within cylinder bore 3. The programmed move distance specifies, for example, either an absolute or an incremental distance. The absolute distance specifies a distance from a home position, which is the piston 5 stopped at either end of the cylinder against sealing heads 22 or 24, while the incremental distance specifies a distance from a current position of the piston 5 to a new position. Home position is preferably determined automatically by the controller/drive 100 upon power up or upon receiving a home instruction and is achieved by moving the piston 5 slowly until it reaches an end of the cylinder or a hard stop. Homing is performed while gas is applied for forward or backward motion of the piston 5 and while the brake 52 is engaged to maintain the piston 5 at a slow homing speed. Upon reaching the home position, the encoder counter is set to zero.

The maximum speed is the maximum desired speed that the piston 5 achieves during acceleration. The acceleration time specifies the amount of desired time for the piston 5 to accelerate from zero (no movement) to the entered maximum speed. The deceleration time specifies the amount of desired time for the piston 5 to decelerate from the maximum speed to zero (no movement). A position tolerance may also be entered by the user to define the motion profile, or a default position tolerance may be used. The position tolerance specifies the amount of acceptable error between the desired and actual end position of the piston 5. For example, it may specify a repeatability of up to 0.01 inches such that the actual position of the piston 5 is within 0.01 inches of the desired position on successive movements. A holding torque may further be entered by the user, or a default value accepted. The in-position holding torque may be set from 0 to 100% of the maximum brake torque of the brake 52. During dwell time (non-motion of the piston 5), especially in horizontal applications, it is often possible to reduce the torque necessary to hold a load. By reducing the holding torque, as in stepper systems, the efficiency is improved and the holding device is not required to dissipate as much heat, therefore, improving the allowable duty cycle.

Based upon the stored motion profile, various graphical examples of which are shown in FIG. 20, the processor 102 executes the program stored in memory storage device 104 to receive position signals from the rotary encoder 44, process the position signals, and provide appropriate control signals to the valves 74 and 76, and to the brake 52. The controller/drive 100, through the processor 102, utilizes feedback techniques (described in further detail below) to control the movement of the piston 5 substantially consistent with the programmed motion profile. As shown in FIG. 20, the motion profiles established by the user are generally of a trapezoidal configuration, wherein the left-hand side indicates the acceleration of the piston 5, the top flat portion indicates a constant velocity of the piston 5, and the right-hand side indicates the deceleration of the piston 5. It should be noted that the motion profile may differ from a trapezoidal configuration in response to programmed position parameters.

More particularly, the controller/drive 100 provides control signals on the lines 80 and 82 to control opening and closing of the valves 74 and 76. It also provides a control signal on the line 84 to control the brake 52. With the proportional brake 52 of the preferred embodiment, the control signal on the line 84 controls the magnitude of the current provided to the brake 52 and thus the amount of force by the brake 52 applied to shaft 42. By controlling the magnitude of the braking force applied to the shaft 42 in combination with the air pressure provided to or exhausted from the chambers 7 and 8, the movement of the piston 5 can be controlled. Such control can include the position at which the piston is stopped as well as the speed or motion profile at which the piston moves to the desired stop position. The control signals are generated through processing of the position signals received from the rotary encoder 44. In particular, the rotary encoder 44 provides signals indicating a relative angular position of shaft 42, thus, providing an indication of a corresponding linear position and movement of belt 12 as it rotates the shaft 42 via the pulley 30.

II.B. Control Scheme

Figure 21:
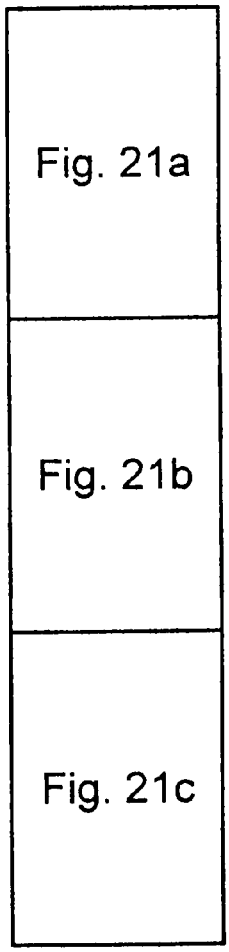
FIG. 21 is a flow chart of the operation of the system of the present invention.

FIG. 21 is a flow chart that provides a detailed view into the operation of system 1, and specifically the control loops utilized within controller/drive 100 to achieve the operation described above. Upon receiving the motion profile parameters, i.e., move distance, maximum speed, acceleration time, and deceleration time, and upon receiving a position command from a user or program, per input block 120, controller/drive 100 operates to generate the motion profile based on the specified acceleration time, deceleration time and speed (and any motion profile adjustments determined in a previous cycle), per operations block 122. In doing so, the controller/drive 100, having previously established the home position and the encoder count corresponding to the home position, converts the move distance and the position command into corresponding encoder counts. Therefore, as the controller/drive 100 detects position signals from the rotary encoder 44, which it receives as counts indicating a relative angular position of shaft 42, it can readily compare the detected encoder counts with the encoder counts calculated from the motion profile information.

Next, processor 102 of controller/drive operates to compare the current position of the piston 5 with the commanded position of the piston 5, per decision block 124. In particular, the present position is detected through a signal on the line 78 received from rotary encoder 44. That detected present position is compared with the motion profile to determine if the position error with respect to the commanded position is less than the position tolerance. If the current position is within the position tolerance, the piston 5 is at the commanded position, the move is complete, and the valves 74 and 76 are opened to equalize the pressure on either side of the piston 5. Controller/drive 100 then awaits a new position command, per input block 120.

If the current position is not within the position tolerance, the controller/drive 100 operates to store the amount of position overshoot or undershoot, per operations block 127. Preferably the overshoot or undershoot values are placed into a 32×32 array based on 32 actuator regions that span the stroke of the actuator. In the situation of an overshoot of the target position by the piston 5, the starting region, ending region and the amount of overshoot in distance are noted in the array. In the case of another move in the same starting and ending regions, per input block 120, the overshoot distance will be compensated for by beginning the deceleration at an earlier position, i.e. the amount of overshoot distance is subtracted from the beginning deceleration position. In the situation of an undershoot, i.e., the commanded motion profile indicates that the target position should have been reached at this time but has not yet been reached, the starting region, ending region, and the amount of undershoot (the calculated distance from the target position) are noted in the array. In the case of another move in the same starting and ending region, per input block 120, the undershoot distance will be compensated for by delaying the deceleration by the undershoot distance. The overshoot/undershoot adjustment is calculated per operations block 129.

Figure 22:
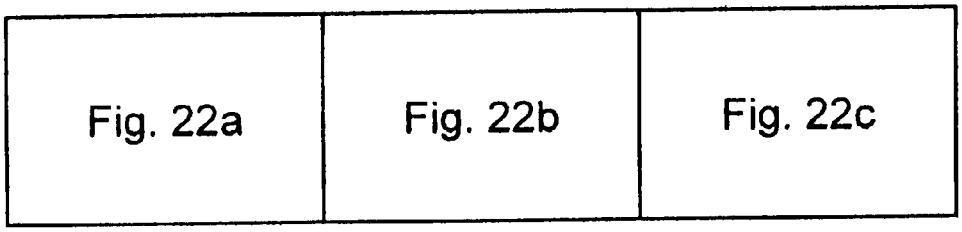
FIG. 22 is a block diagram of the control scheme of the present invention.
Figure 21C:
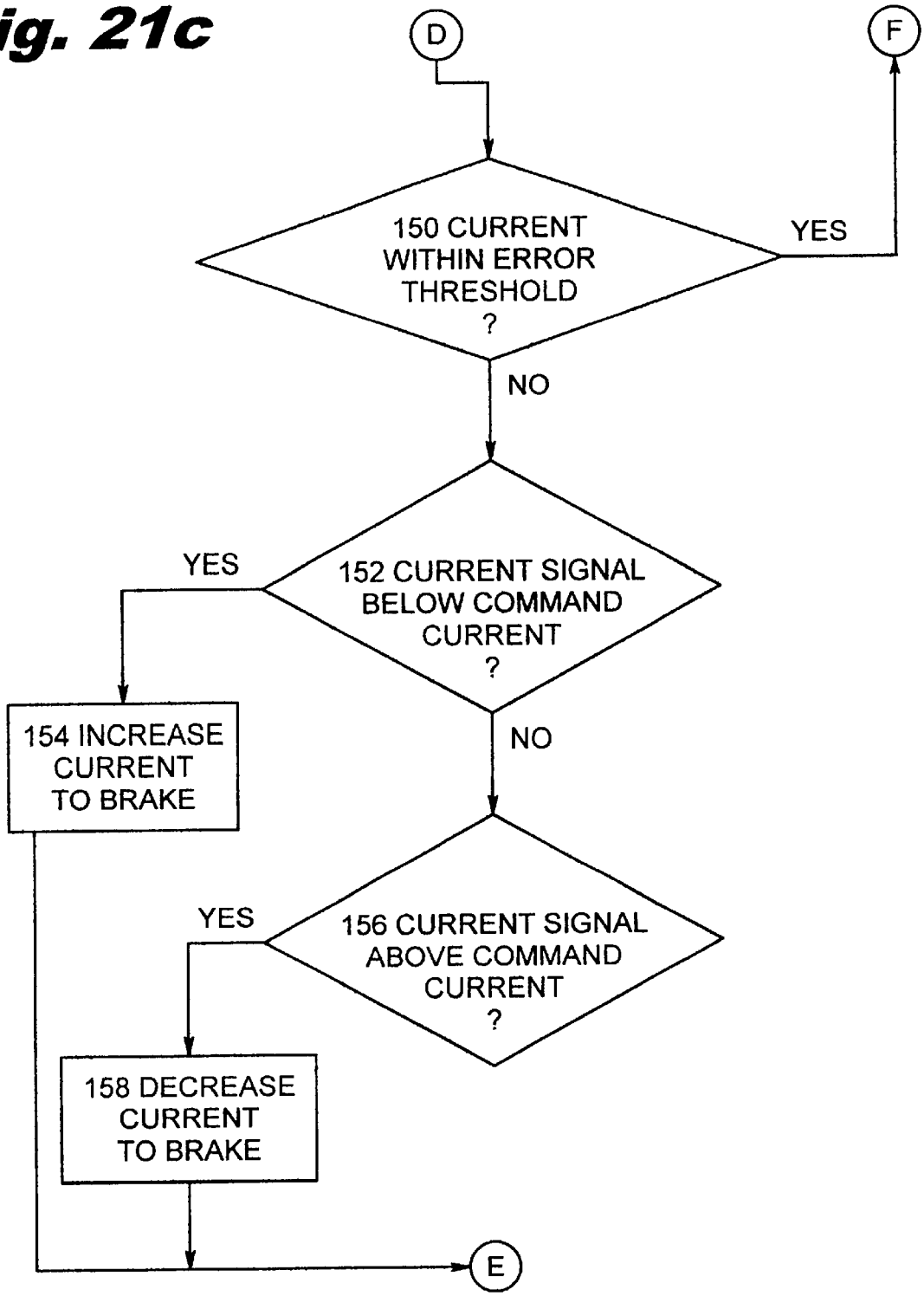
Figure 22A:
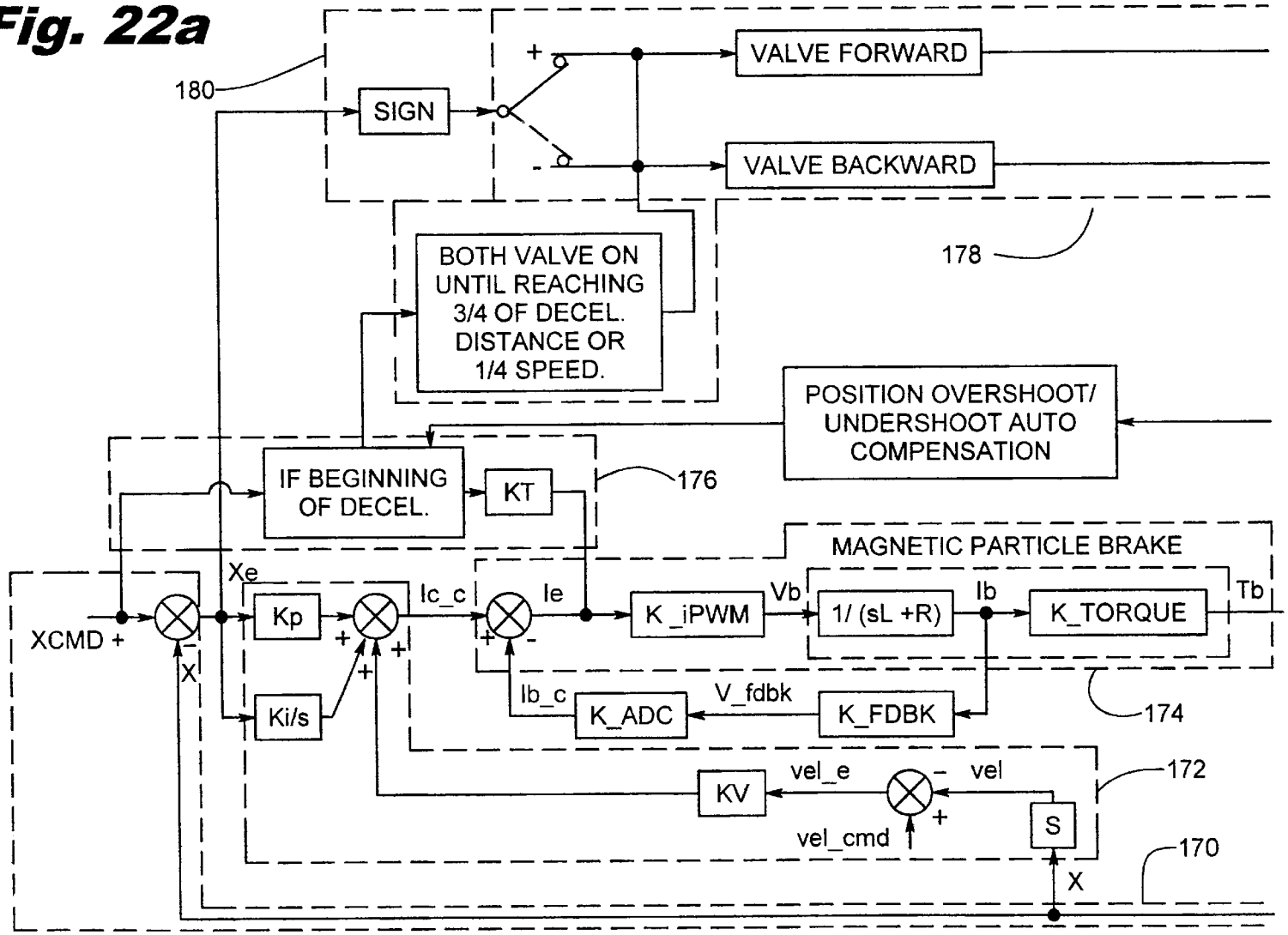
Figure 22B:
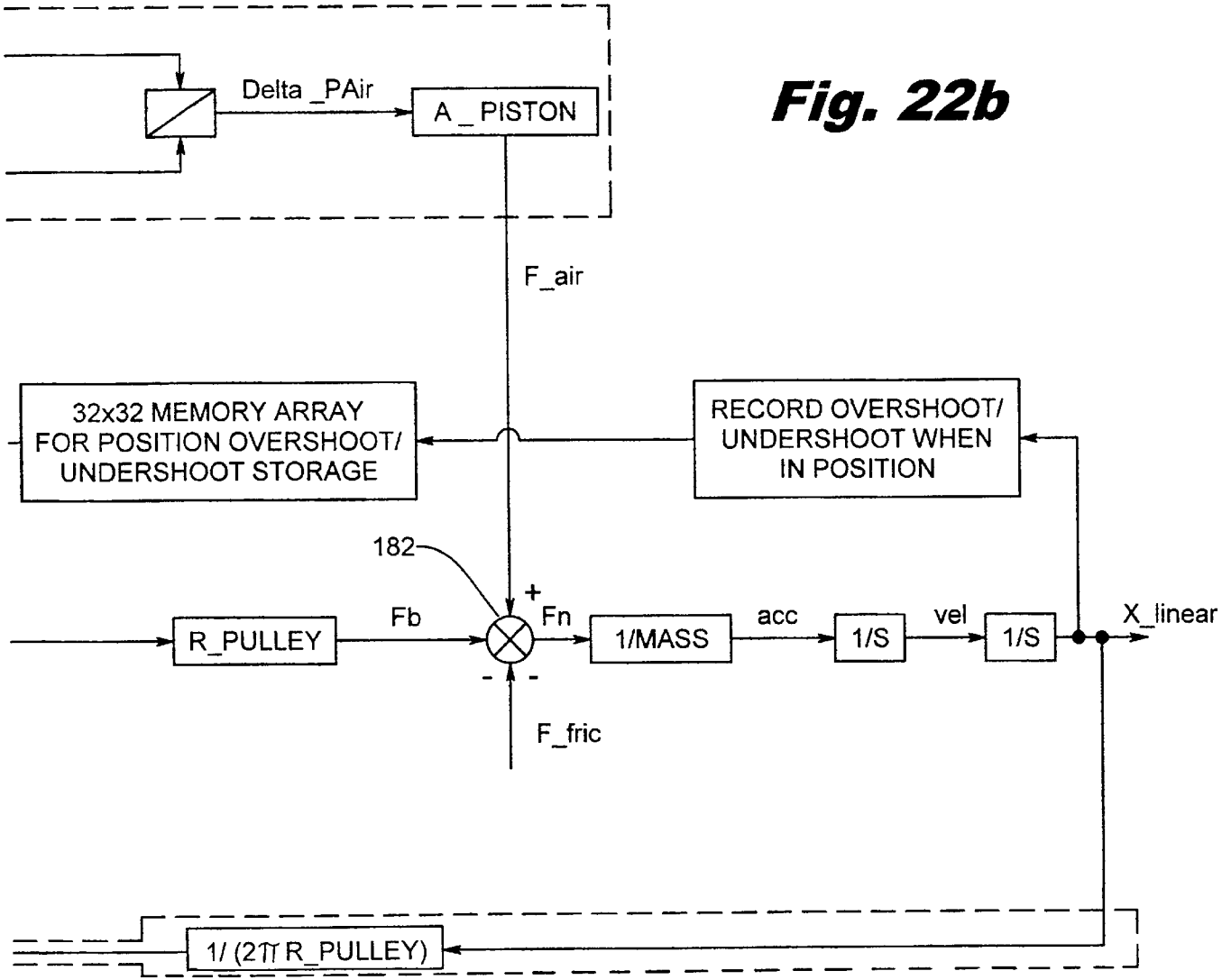

After storing any overshoot or undershoot values, the controller/drive 100 next determines whether the current position of piston 5 is the beginning deceleration position as determined by the motion profile, per decision block 126. If the current position is indeed the beginning deceleration position, a deceleration constant, KT is integrated into the control loop, per operations block 128 and the valves 74 and 76 are switched by controller/drive 100 to force pressurized air to act on both sides of the piston 5. As described in connection with FIG. 6, this equal and opposite pressurization of both the forward and reverse sides of the piston 5 aids in the deceleration of the piston 5 and limits the load on the brake 52 and the belt 12. By adjusting valve $C_v$ (a number expressing the ability of a fluid to flow under pressure difference or pressure drop, also referred to as flow capacity or flow coefficient), the air recirculation can significantly help to stop the load or load atop the piston 5. Once the piston 5 reaches a predetermined deceleration distance or speed, preferably 75% of the deceleration distance, or 25% of the constant speed, whichever comes first, the valves 74 and 76 are switched back to the same position as prior to starting the deceleration, per operations block 132 (the changing of the valves is noted in the motion profile of FIG. 23). Note that KT will continue to influence the deceleration until the piston 5 is completely stopped, as can be seen in FIG. 22.

If the current position of the piston 5 is not the beginning deceleration position, the controller/drive 100 controls movement of the piston 5 to perform the commanded move. In doing so, the controller/drive 100 determines a motion direction through the signal from the rotary encoder 44 and opens the valve 76 or the valve 74 depending on the direction of motion determined by the motion profile, per operation block 134. The controller/drive 100 then monitors the position and velocity of the piston 5 through the processing of position signals received from the rotary encoder 44, per operations block 136.

Having converted the programmed command speed and position information into encoder counts, the controller/drive 100 is able to compare them to the monitored speed and position, which are provided as encoder counts from the rotary encoder 44 to the controller/drive 100. Specifically, controller/drive 100 operates to compare the current speed, as determined by the rate of encoder counts from the rotary encoder 44, with the programmed command speed according to the motion profile, per operations block 138.

If the speed or velocity of piston 5 is too fast compared to the command speed, as determined per decision block 140, the current to the brake 52 is increased, per operations block 142, thereby increasing the braking force, slowing the rotation of the shaft 42, and slowing the linear movement of the piston 5. If the speed or velocity of the piston 5 is not too fast, the controller/drive 100 determines if the speed or velocity of piston 5 is too slow compared to the command speed, per decision block 144. If the speed of the piston 5 is too slow, the current to the brake 52 is decreased, per operations block 146, thereby decreasing the braking force, speeding the rotation of the shaft 42, and speeding the linear movement of the piston 5.

In controlling the brake 52, the controller/drive 100 also compares a current signal with the commanded current, per operations block 148. The current signal is the amount of electric current to the brake 52. The commanded current is calculated according to the following equation:

$$KP^*\Delta x+KV^*\Delta v \tag{1}$$

where: KP=proportional gain, a position constant $\Delta x$=the position error from the motion profile KV=derivative gain, a velocity constant $\Delta v$=a velocity error calculated from a difference between the actual speed of the piston 5 as determined by a rate of the received encoder counts and the speed in the motion profile.

If the comparison indicates that the signal current is within an acceptable error threshold of the command current, as determined per decision block 150, the move of the piston 5 is complete and the controller/drive 100 returns to the monitoring of the position and velocity of piston, per operations block 136. If the comparison indicates that the signal current is outside the acceptable error threshold, the controller/drive 100 executes a current loop to determine an amount by which to increase or decrease the current to the brake 52.

If the signal current is below the calculated command current, as determined per decision block 152, the controller/drive 100 operates to increase the current to the brake 52, per operations block 154. If the signal current is above the calculated command current, as determined per decision block 156, the controller/drive 100 operates to decrease the current to the brake 52, per operations block 158. The controller/drive 100 then operates to loop back to operations block 148 wherein the current signal is once again compared by the controller/drive 100 against the command current for the determination of whether the signal current is within an acceptable error threshold and, correspondingly, whether the move of the piston 5 is complete.

FIG. 22 describes the control scheme of the system 1 in a standard block-diagram format. The control loops shown within the scheme include: (1) a position loop 170 for feedback comparison of the commanded position and the actual position of the piston 5, which generally comprises the blocks of 120, 122, and 124 of the flowchart of FIG. 21; (2) a velocity loop 172 for feedback comparison of the commanded velocity and the actual velocity of the piston 5, which generally comprises the blocks of 134 through 146 of the flowchart of FIG. 21; and (3) a current loop 174 for feedback comparison of the commanded brake current and the actual brake current supplied to the brake 52, which generally comprises the blocks of 148 through 158 of the flowchart of FIG. 21.

The above three loops utilize the standard control parameters of a servo-system including: (1) proportional gain, KP; (2) integral gain, KI; and (3) derivative gain, KV. The proportional gain, KP, is the position error gain that determines how sensitively the controller/drive 100 will respond to the position error (difference in command and actual position). The controller/drive 100 responds to position error more effectively when increasing the KP gain. However, setting the KP gain too high will lead the system 1 toward positioning instability. As such, the controller/drive 100 is preferably programmed with a user-changeable default gain on the order of 24.

The integral gain, KI, is the position error integral gain. The controller/drive 100 operates to accumulate position error while the piston 5 is approaching the target position and multiply the error by the integral gain. The result is used by the controller/drive 100 to determine the required brake current for positioning. The controller/drive 100 is preferably programmed with a user-changeable default integral gain on the order of 1.

The derivative gain, KV, is the speed error gain. The KV gain determines how effectively the controller/drive 100 responds to the speed error while the piston 5 is in motion. Increasing the KV gain reduces the speed following error. However, jerky motion occurs if the KV setting is too high. As such, the controller/drive 100 is preferably programmed with a user-changeable default derivative gain on the order of 4.

In addition to the feedback loops, the block diagram depicts a deceleration compensation path 176 within system 1 that enters into effect upon the piston 5 beginning its deceleration, as determined by the motion profile. The deceleration compensation path 176 generally comprises the blocks of 126 and 128 of the flowchart of FIG. 21. The deceleration compensation path 176 uses a control parameter beyond the standard PID parameters of a servo-system. This control parameter is a deceleration current constant gain, KT. The KT gain is used to set the minimum brake current while decelerating the load that is secured to the carrier 6. It is used to adjust for position overshoot, position undershoot, and deceleration profile linearity when the carrier 6 approaches the final position. The controller/drive 100 is preferably programmed with a user-changeable default KT gain on the order of 48. The deceleration compensation path 176 is also the path that initiates the energizing of both of the valves 74 and 76 to aid in the braking of the piston 5, as indicated by path 178 (which is also reflected in block 130 of the flowchart of FIG. 21).

The four gain parameters KP, KI, KV, and KT allow the controller/drive 100 to compensate for varying loads, variations in gas supply pressure (e.g., system 1 is able to maintain a positional profile in view of pressure variations), and temperature variations. Specifically, the gain parameters and the controller/drive 100 allow system 1 to have a position repeatability (tolerance) of +/−0.01 inches, or absolute value of 0.01, regardless of stroke length. Stroke length is preferably in the range of 24 inches to up to 50 feet or more depending upon the capability of design the actuator to support such stroke lengths. Further, system 1 is able to handle changes in load without any changes in the gain parameters. For example, the piston 5 and carrier 6 may carry a first load from a first position to a second position and a second load from the second position to a third position, wherein the first and second load vary by at least 33% (up to the entire range of the load specification of the actuator and brake). In doing so, system 1 is able to maintain its position repeatability of +/−0.01 inches without any change in the gain parameters. Note that the third and first position may be the same or different positions. A portion of path 178 overlaps that of path 180, which is the output path from the position control loop 170, whereby any motion of the piston 5 that is required as determined by the position control loop 170 is initiated by determining the direction of the motion (sign) and activating the appropriate forward or backward valve 74 or 76, corresponding to block 134 of the flowchart of FIG. 21. The actual position of the piston 5 is calculated by the controller/drive 100 by initially summing the forces acting on the piston 5 at summing junction 182. These forces include: (1) a thrust force, which is determined from the pressure difference between chambers 7 and 8; (2) a stopping force, which is determined from the brake torque and pulley pitch radius; and (3) an external friction force, due to the friction between the piston 5 and the cylinder bore 3. The result of the summed forces is the net force necessary to drive the load secured to carrier 6 to the command position.

The net force creates the motion that is detected by the controller/drive 100 and from that motion the controller/drive 100 detects the position of the piston 5. Velocity is further derived from the position signal. Upon reaching the command position, within the desire tolerance, any overshoot or undershoot in the position of the piston 5 is recorded and utilized for future compensations to the KT gain, per path 184, which corresponds to blocks 127 and 129 of the flowchart of FIG. 21.

Figure 23:
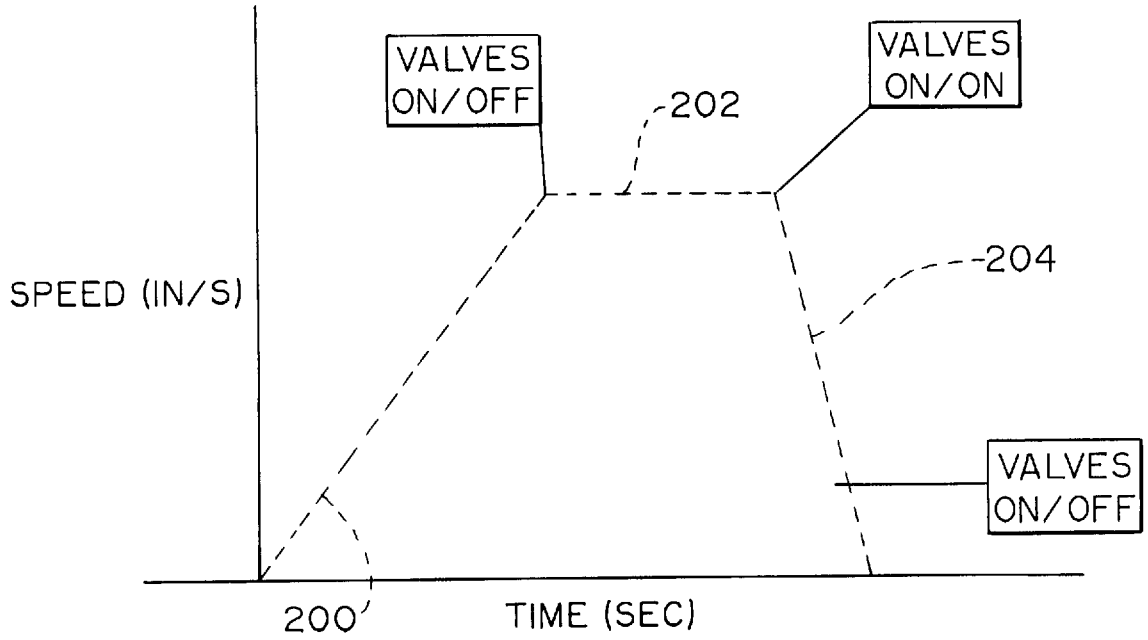
FIG. 23 is a motion profile including system operational indicators.

The operation of system 1 may also be understood with reference to the motion profile of FIG. 23. As indicated above motion profiles are user-defined by programming the move distance, the maximum speed, the acceleration time, and the deceleration time. How well the actual motion of system 1 follows the theoretical profile is based on the system supply pressure, system $C_v$, the load, and how well system 1 is tuned. An appropriately tuned system can generally assure a maximum velocity and deceleration to be within 10% of the programmed values. During acceleration, indicated by the item number 200 on FIG. 23, the current is applied to the brake 52 as required to limit the rate of acceleration to the programmed value. The maximum ramp rate of the acceleration is limited by traditional pneumatic cylinder limitations. During the constant velocity portion of the profile, indicated by item number 202 on FIG. 23, the information from rotary encoder 44 is evaluated to supply a brake current necessary to maintain the maximum speed.

Deceleration, indicated by item number 204, is the most tuning critical portion of the profile. In order to reduce the high speed thrust requirement of the belt 12 and torque of the brake 52, both of the valves 74 and 76 are de-energized to allow air circulation through the valves 74 and 76 during the initial part of the deceleration. The gain settings controls how linear the deceleration is over the programmed deceleration time. If the ratio of KT to KI is not appropriately set, a rapid deceleration will be experienced with a short slow move into final position. However, with a properly tuned system, the positional repeatability of the system 1 can be programmed to +/−0.010 inches (+/−0.254 mm) with increments of 0.006 inches (0.15 mm).

II.C. Auto Tune

The controller/drive 100 preferably incorporates a digital auto tuning program to enable easy user setup of system 1. All automatic adjustments are preferably made within the software that sets the system gain parameters, thus eliminating the time-consuming adjustments required by potentiometers. The auto tuning program implemented in the controller/drive 100 firmware cycles the carrier 6 to positions between ¼ to ¾ of the entire stroke length while searching for an optimal set of servo parameters. The user must, however, specify the bore size and usable stroke length of system 1 before conducting any auto tuning. The auto tune routine preferably moves the carrier 6 up to 15 cycles while finding the best set of servo-parameters, and can do so with or without a load. In determining the best set of parameters, the auto tune function of the controller/drive 100 looks to three factors: (1) overshoot of the position of the piston 5; (2) undershoot of the position of the piston 5; and (3) velocity following error (overshoot/undershoot). The goal of the auto tune function is to minimize these factors and does so by adjusting the various gain parameters that are set as the defaults within the firmware of the controller/drive 100, e.g., adjusting KT for overshoot, adjusting KV and KI for undershoot, and adjusting KV for velocity following error. KV, KI, and KT may changed at the same time or on an individual basis. The proportional gain KP is not adjusted during auto tune.

III. System Summary

System 1 is designed to be a low cost position and velocity control system relative to electric motion systems, without the setup and control challenges of traditional proportional valve pneumatic servo systems. System 1 is intended for applications not requiring positional repeatability better than +/−0.010 inches. Motion profiles are user defined by programming the move distance, the maximum speed, acceleration time, and deceleration time. System variables, including supply pressure, valve Cv, the load, and how well the system 1 is tuned, do not effect the final repeatability of the system 1, however, they will influence how well the actual motion follows the theoretical profile. An appropriately tuned system can generally assure velocity to be within 10% of the programmed values, with appropriate air pressure.

System 1 significantly reduces the concerns of changing loads, system friction, vertical operation, setup, tuning, instabilities, and long stroke lengths, typically experienced with pneumatic servo systems. The approach used in the system 1 accomplishes this by using the muscle of air to provide thrust, and a current controlled magnetic particle brake to provide proportional braking for position and velocity control. This approach significantly reduces the effects of directly attempting to control a compressible fluid through proportional valves, or trying to predict when to activate an on/off brake to achieve a desired position.

The system 1 also considers duty cycle limitations due to heat dissipation requirements of the brake 52. Heat generation takes place not only during deceleration of a load, but also during regulation at a constant speed. It is desirable to operate at a minimum supply pressure necessary for the application. This will minimize the heat generated by the brake 52, therefore, maximizing the application's duty cycle. In a vertical application it is recommended to operate at a different pressure for each direction of motion, depending on the duty cycle desired. There may also be a minimum speed that can be achieved with a given air pressure, determined by the duty cycle desired.

Although the preferred embodiment has been described, it will be recognized that numerous changes and varations can be made and that the scope of the present invention is intended to be defined by the claims.

What is claimed is:

1. An automated method of controlling a pneumatic actuator operably connected to a piston in a chamber and to a proportional brake wherein a sensor system generates measurement values representative of a movement of the piston, the method comprising:

supplying a pressurized gas to a forward side of the piston to accelerate the piston along a stroke; and beginning at a deceleration point along the stroke that is determined at least in part in response to the measurement values generated by the sensor system, supplying the pressurized gas to a reverse side of the piston while continuing to supply the pressurized gas to the forward side of the piston; and selectively activating the proportional brake in response to the measurement values generated by the sensor system to stop the pneumatic actuator within a predetermined tolerance of a desired stopping position.

2. The method of claim 1 wherein upon reaching a predetermined condition after the deceleration point is determined and at least in part in response to the measurement values generated by the sensor system, the pressurized gas is discontinued to the reverse side of the piston but is continued to be supplied to the forward side of the piston.

3. The method of claim 1 wherein the tolerance is a fixed value that is determined distinct from a percentage of a length of the stroke.

4. The method of claim 1 further comprising:

entering a motion profile prior to any movement of the piston; and selectively activating the brake in response to the measurement values generated by the sensor system to provide servo control during movement of the piston in accordance with the motion profile.

5. The method of claim 1 wherein the proportional brake is activated to control a velocity of the piston during acceleration of the piston.

6. An automated method of controlling a pneumatic actuator operably connected to a piston in a chamber and to a brake wherein a sensor system generates measurement values representative of a movement of the piston, the method comprising:

supplying a pressurized gas to a forward side of the piston to accelerate the piston along a stroke; and beginning at a deceleration point along the stroke that is determined at least in part in response to the measurement values generated by the sensor system, supplying the pressurized gas to a reverse side of the piston while continuing to supply the pressurized gas to the forward side of the piston; and selectively activating the brake in response to the measurement values generated by the sensor system to stop the pneumatic actuator within a predetermined tolerance of a desired stopping position, wherein after at a predetermined condition after the deceleration point is determined at least in part in response to the measurement values generated by the sensor system the pressurized gas is discontinued to the reverse side of the piston but is continued to be supplied to the forward side of the piston; and wherein the predetermined condition is the first of a defined percentage of a distance from the deceleration point to the desired stopping position and a defined percentage reduction in a velocity of the piston.

7. The method of claim 6, wherein the brake is activated to control a velocity of the piston during acceleration of the piston.

8. A precision servo control system for a pneumatic actuator comprising:

a pneumatic actuator having a positionable component with a stroke length;

a supply of pressurized gas operably connected to provide a forward thrust and a reverse thrust to said positionable component;

a brake operably connected to said actuator;

a sensor system that determines a measurement of said positionable component along said stroke length; and a servo control system electrically connected to said supply, said brake, said sensor system and said pneumatic actuator, wherein said control system operates to initiate the forward thrust to move the positionable component along said stroke length and once a deceleration point along said stroke length is reached initiates the reverse thrust while maintaining the forward thrust and simultaneously selectively applies the brake to stop the positionable component within a predetermined tolerance of a desired stopping position.

9. The system of claim 8, wherein the brake controls a velocity of the positionable component during the forward thrust.

10. A precision servo control system for a pneumatic actuator comprising:

a pneumatic actuator having a positionable component with a stroke length;

a supply of pressurized gas operably connected to provide a forward thrust and a reverse thrust to said positionable component;

a brake operably connected to said actuator;

a sensor system that determines a measurement of said positionable component along said stroke length; and a servo control system electrically connected to said supply, said brake, said sensor system and said pneumatic actuator, wherein said control system operates to initiate the forward thrust to move the positionable component along said stroke length and once a deceleration point along said stroke length is reached initiates the reverse thrust while maintaining the forward thrust and simultaneously selectively applies the brake to stop the positionable component within a predetermined tolerance of a desired stopping position, wherein the brake is a proportional brake.

11. The system of claim 10, wherein the supply of pressurized gas is operably connected to said pneumatic actuator via at least one directional valve.

12. The system of claim 10 wherein the control system is separate from the pneumatic actuator in a housing having a keypad and a display to enter and display commands and having a communication port that allows commands to be provided from a remote computer.

13. The system of claim 10, wherein the control system is separate from the pneumatic actuator in a housing that provides at least one drive output to control the supply of pressurized gas and provides at least one current output to control the brake.

14. The system of claim 10 wherein the proportional brake controls a velocity of the positionable component during the forward thrust.

15. A pneumatic-actuator system comprising:

an actuator having a pneumatically-positionable component; and a control system having at least one tunable gain parameter, wherein said control system moves said component from a first position to a second position while said component carries a first load while maintaining a predetermined position tolerance without a change in any of said at least one tunable gain parameters, and wherein said control system moves said component from said second position to a third position carrying a second load, said second load at least 33% different from said first load while maintaining said predetermined position tolerance without a change in any of said at least one tunable gain parameters.

16. The system of claim 15 wherein said second load may differ from said first load up to an entire range of a load specification of said actuator.

17. The system of claim 15 wherein said first position and said third position represent the same position.

18. An automated method of controlling a pneumatic actuator operably connected to a piston in a chamber and to a brake wherein a sensor system generates measurement values representative of a movement of the piston, the method comprising:

supplying a pressurized gas to a forward side of the piston to accelerate the piston along a stroke;

beginning at a deceleration point along the stroke that is determined at least in part in response to the measurement values generated by the sensor system, selectively activating the brake in response to the measurement values generated by the sensor system to stop the pneumatic actuator within a predetermined tolerance of a desired stopping position; and in the event of an overshoot where the piston advances beyond the desired stopping position by more than the predetermined tolerance, discontinuing supplying the pressurized gas to the forward side of the piston;

fully activating the brake to hold the piston in position;

supplying a pressurized gas to a backward side of the piston; and selectively partially releasing the brake to allow the piston to move back along the stroke to the desired stopping position.

19. The method of claim 18 further comprising activating the brake to control a velocity of the piston during acceleration of the piston.

20. An automated method of controlling a pneumatic actuator operably connected to a piston in a chamber and to a brake wherein a sensor system generates measurement values representative of a movement of the piston, the method comprising:

supplying a pressurized gas to one side of the piston to accelerate the piston along a stroke;

selectively activating the brake to maintain a velocity of the piston below a predetermined homing speed;

monitoring the measurement values of the sensor system to determine when the piston has stopped moving along the stroke;

setting a reference value of the sensor system to zero to represent a home position based on the measurement values for a current position of the piston when it has stopped.

21. The method of claim 20 further comprising:

releasing the brake after the piston has stopped; and confirming that the piston remains stopped.

22. The method of claim 21 further comprising:

repeating the process in an opposite direction by supplying pressurized gas to an other side of the piston.

* * * * *